US005425243A

United States Patent [19]

Sanuki et al.

[11] Patent Number: 5,425,243

[45] Date of Patent: Jun. 20, 1995

[54] MECHANISM FOR DETECTING COMPLETION OF ICE FORMATION IN ICE MAKING MACHINE

[75] Inventors: Masao Sanuki; Tadashi Sakai, both of Toyoake, Japan

[73] Assignee: Hoshizaki Denki Kabushiki Kaisha, Aichi, Japan

[21] Appl. No.: 101,356

[22] Filed: Aug. 3, 1993

[30] Foreign Application Priority Data

Aug. 5, 1992 [JP] Japan ..... 4-61010 U
Sep. 9, 1992 [JP] Japan ..... 4-69818 U

[51] Int. Cl.[6] ..... F25C 1/12
[52] U.S. Cl. ..... 62/138; 62/353
[58] Field of Search ..... 62/138, 353

[56] References Cited

U.S. PATENT DOCUMENTS 3,418,823 12/1968 Vivai ..... 62/138
3,791,166 2/1974 Maleck ..... 62/138
4,199,956 4/1980 Lunde ..... 62/138
4,207,750 6/1980 Simkens ..... 62/138

*Primary Examiner*—William E. Tapolcai
*Attorney, Agent, or Firm*—Koda and Androlia

[57] ABSTRACT

Disclosed is a mechanism for detecting completion of ice formation and for preventing such opacification of ice pieces in an ice making machine, in which a multiplicity of freezing fingers formed on the lower surface of a freezing base plate are dipped in the water supplied to a freezing chamber defined in a water tray to carry out a freezing operation and form inverted dome-shaped ice pieces gradually around the freezing fingers; characterized in that the mechanism consists of a rocking plate which is rocked with respect to the freezing fingers by a rocking means; and a position detector which is actuated when a predetermined size of ice pieces are formed around the freezing fingers, and the rocking plate is brought into contact with these ice pieces. In this ice making machine, completion of formation of ice pieces around the freezing fingers is designed to be detected easily and securely by the signal from the position detector, and also transparent ice pieces of high commercial value free from opacification can be formed, while opacification of ice pieces to be formed around the freezing fingers can effectively be prevented since the water to be frozen in the water tray is fully agitated by the rocking motion of the rocking plate having formed thereon a multiplicity of through holes and/or side walls also having such through holes.

8 Claims, 36 Drawing Sheets

MECHANISM FOR DETECTING COMPLETION OF ICE FORMATION IN ICE MAKING MACHINE

BACKGROUND OF THE INVENTION

This invention relates to a mechanism for detecting completion of ice formation in an ice making machine. More particularly, this invention relates to a mechanism for detecting completion of ice formation in an ice making machine, in which a multiplicity of freezing fingers formed on the lower surface of a freezing base plate are dipped in the water supplied to a freezing chamber defined in a water tray to carry out a freezing operation and form inverted dome-shaped ice pieces gradually around the freezing fingers, wherein completion of formation of ice pieces around the freezing fingers is designed to be detected easily and securely.

Various types of freezing systems have been proposed for automatic ice making machines for making a number of ice pieces such as cubes continuously, and they are suitably employed depending on the applications. For example, the following systems are known:

(1) a so-called closed cell system ice making machine having a multiplicity of freezing cells opening downward defined by a multiplicity of partitions crossing one another, to which water is injected upward to the respective freezing cells, which are cooled by an evaporator connected to a freezing system, from a water tray disposed below the freezing cells to form ice cubes gradually therein;

(2) a so-called open cell system ice making machine having such freezing cells opening downward, in which water is sprayed upward directly into the freezing cells using no water tray to form ice cubes therein; and (3) a flow-down system ice making machine having a perpendicular freezing plate, in which water is supplied to flow down on one surface of the freezing plate to form a semicylindrical ice block on the corresponding surface.

These three types of ice making machines all employ a forced circulation system and have a water tank for carrying therein a predetermined amount of water to be frozen, and the water in the tank is fed by a pump to the freezing cells or to the perpendicular freezing plate disposed in a freezing unit, while the unfrozen portion of the water is recovered into the tank to recirculate it to the freezing unit. Accordingly, incidental equipments such as a water tank and a pump for circulating the water to be frozen become necessary in such types of ice making machines. This causes not only complication of the structure of the machine but also production cost elevation and enlargement of the machine. Meanwhile, there has already been proposed a more simplified ice making machine, in which freezing fingers extending downward from the lower surface of a freezing base plate provided with an evaporator thereon are dipped in a predetermined level of water carried in a water tray to form ice pieces around the freezing fingers. This type of ice making machine requires no mechanism for circulating the water to be frozen between the water tray and the water tank during the freezing operation, so that the structure of the machine can be simplified, leading to production cost reduction and down-sizing of the machine, advantageously.

As described above, the last mentioned ice making machine, in which ice pieces are designed to be formed around the freezing fingers merely by dipping them in the water carried in the water tray, enjoys a great advantage that the structure of the machine can be simplified. This type of ice making machine employes a technique of counting the time required for forming ice pieces by a timer as a means for detecting completion of ice formation. In such technique of controlling the freezing operation by a timer, however, the freezing operation is designed to be carried out within a preset time period by the timer in spite of the fact that the time necessary for forming a desired size of ice pieces varies greatly depending actually on the ambient temperature (outer air temperature), so that it can happen that the ice making machine proceeds with an ice releasing operation before ice pieces are fully formed, or that the freezing operation is continued even after formation of the desired size of ice pieces, and the ice pieces are combined with the adjacent ones and deformed, disadvantageously. Accordingly, it can be pointed out that the maintenance and repair of the ice making machine become troublesome, since the preset time in the timer must be adjusted depending on the change in the ambient temperature.

SUMMARY OF THE INVENTION

This invention is proposed in view of the problems inherent in the mechanism for detecting completion of ice formation in the conventional ice making machine, in which ice pieces are designed to be formed around the freezing fingers by dipping them into the water carried in the freezing chamber defined in a water tray, and with a view to overcoming them successfully, and it is an object of this invention to provide a mechanism which can securely detect completion of ice formation without being affected by the change in the ambient temperature (hereinafter simply referred to as the detection mechanism).

The detection mechanisms of this invention as set forth in the appended claims are proposed in order to overcome the above problems and attain the intended objects successfully. According to the detection mechanism in the ice making machine of this invention, in which a multiplicity of freezing fingers formed on the lower surface of a freezing base plate are dipped in the water carried in the freezing chamber defined in a water tray to carry out a freezing operation and form inverted dome-shaped ice pieces gradually around the freezing fingers, completion of ice formation around the freezing fingers can easily and securely be detected.

In the detection mechanism in the ice making machine according to this invention, completion of ice formation can accurately and securely be detected, since it is designed to be detected by a rocking plate which can be abutted directly against the ice pieces formed around the freezing fingers. Accordingly, ice pieces of the same size and of the same quality can constantly be formed without being affected by various conditions including ambient temperature. Further, there is no need of adjusting the preset time in the timer as conventionally been practiced depending on the fluctuation in the ambient temperature, so that maintenance and repair of the ice making machine can be facilitated, advantageously.

DESCRIPTION OF PREFERRED EMBODIMENTS

The detection mechanism in the ice making machine according to this invention will be described below by way of preferred embodiments referring to the attached drawings.

(General constitution of the ice making machine according to first embodiment)

Figure 7:
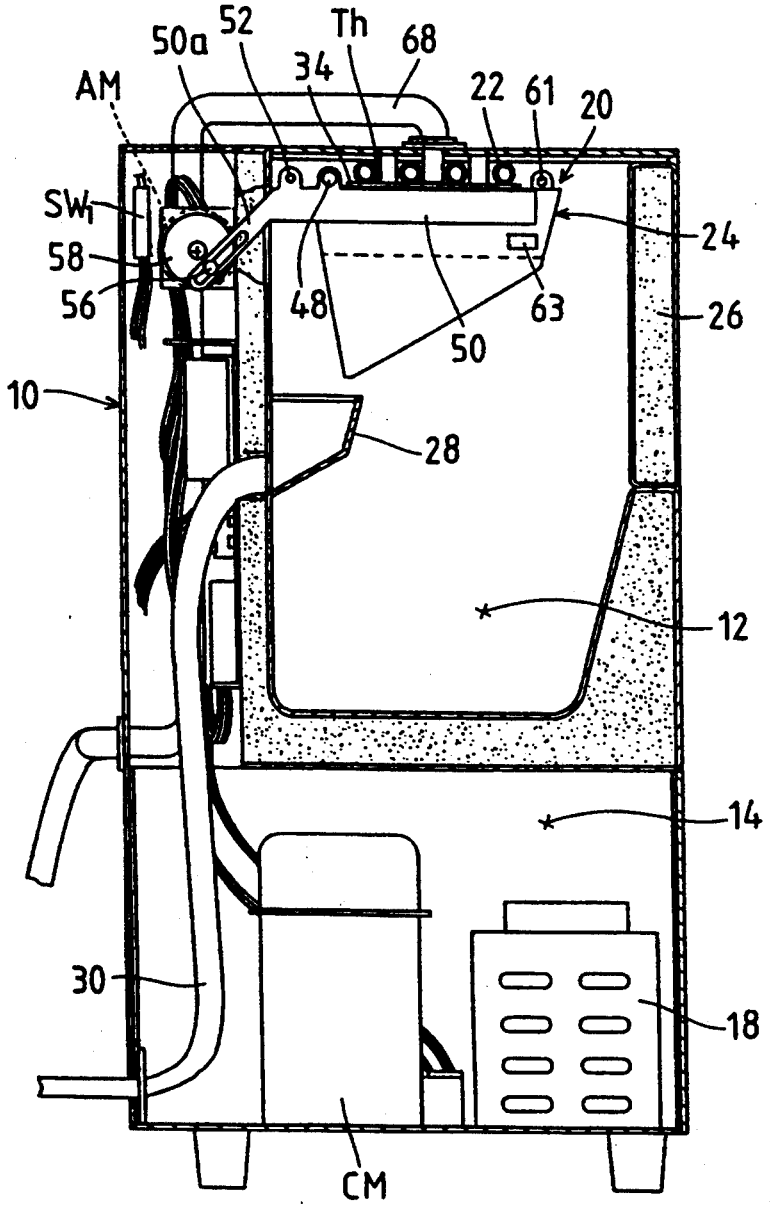
FIG. 7 shows schematically in vertical section the ice making machine in which the detection mechanism is employed.
Figure 8:
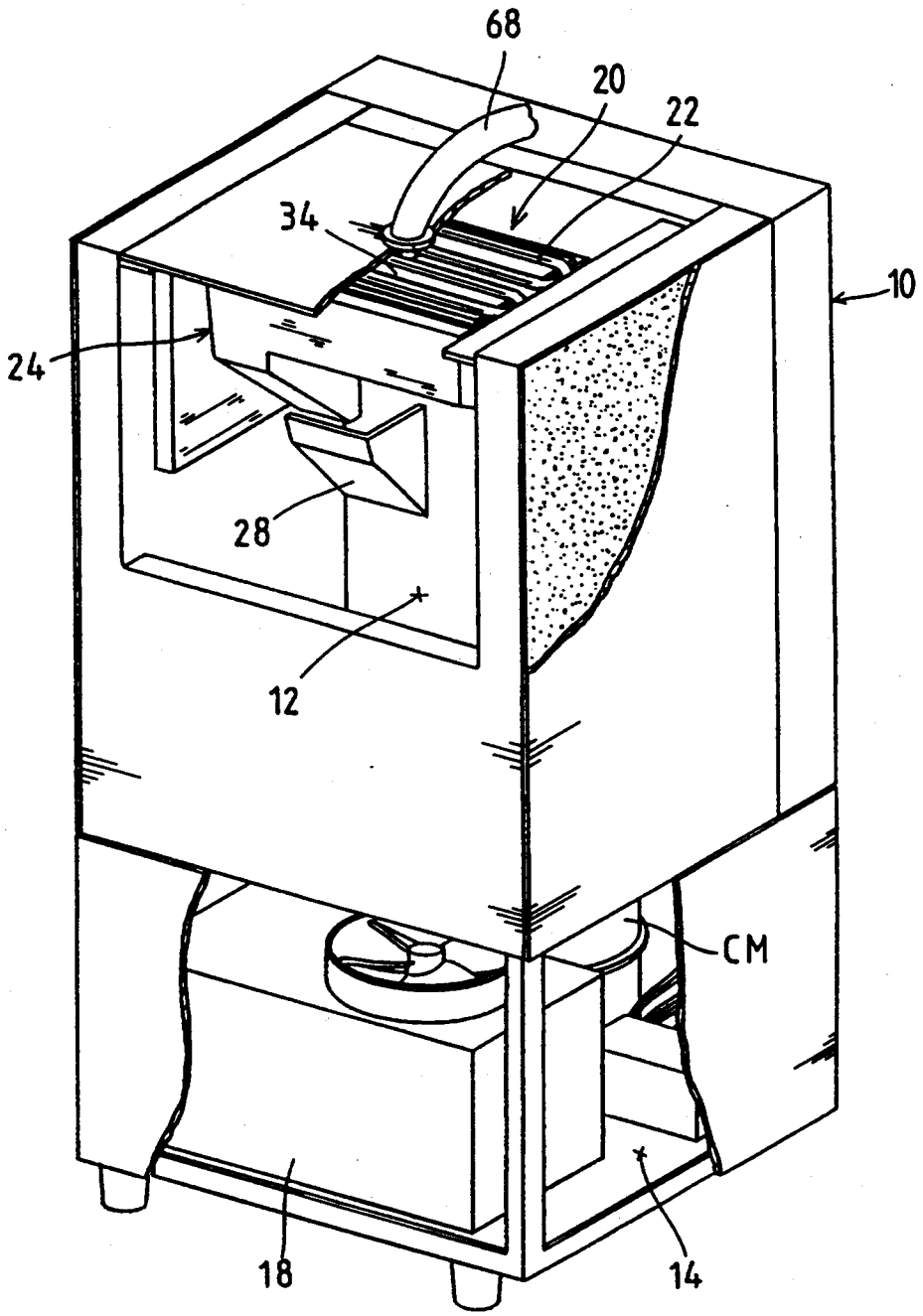
FIG. 8 shows in partially cut-away perspective view of the ice making machine.

FIGS. 7 and 8 show schematically, in cross section and perspective view, respectively, the overall structure of the ice making machine in which the detection mechanism according to a first embodiment of the invention is employed. A rectangular housing 10 constituting the main body of the ice making machine basically has defined therein a lower machine chamber 14 in which the freezing system including a compressor CM and a condenser 18 are housed, an ice bin 12 which can be closed by a door 26, disposed above the lower machine chamber 14, surrounded with a heat insulating material and a freezing unit 20 disposed in the ice bin 12 at an upper position thereof. As will be described later referring to FIGS. 1 and 5, the freezing unit 20 has a water tray 24 in which a predetermined level of water to be frozen is carried and a freezing base plate 34 having freezing fingers 36 to be dipped in the water to be frozen, wherein the water tray 24 is tilted to a predetermined angle upon switching to the ice releasing operation to discharge the water remaining therein to the outside of the machine through a water collecting section 28 and drain pipe 30 as well as to release the ice pieces into the ice bin 12.

(Freezing unit)

Figure 1:
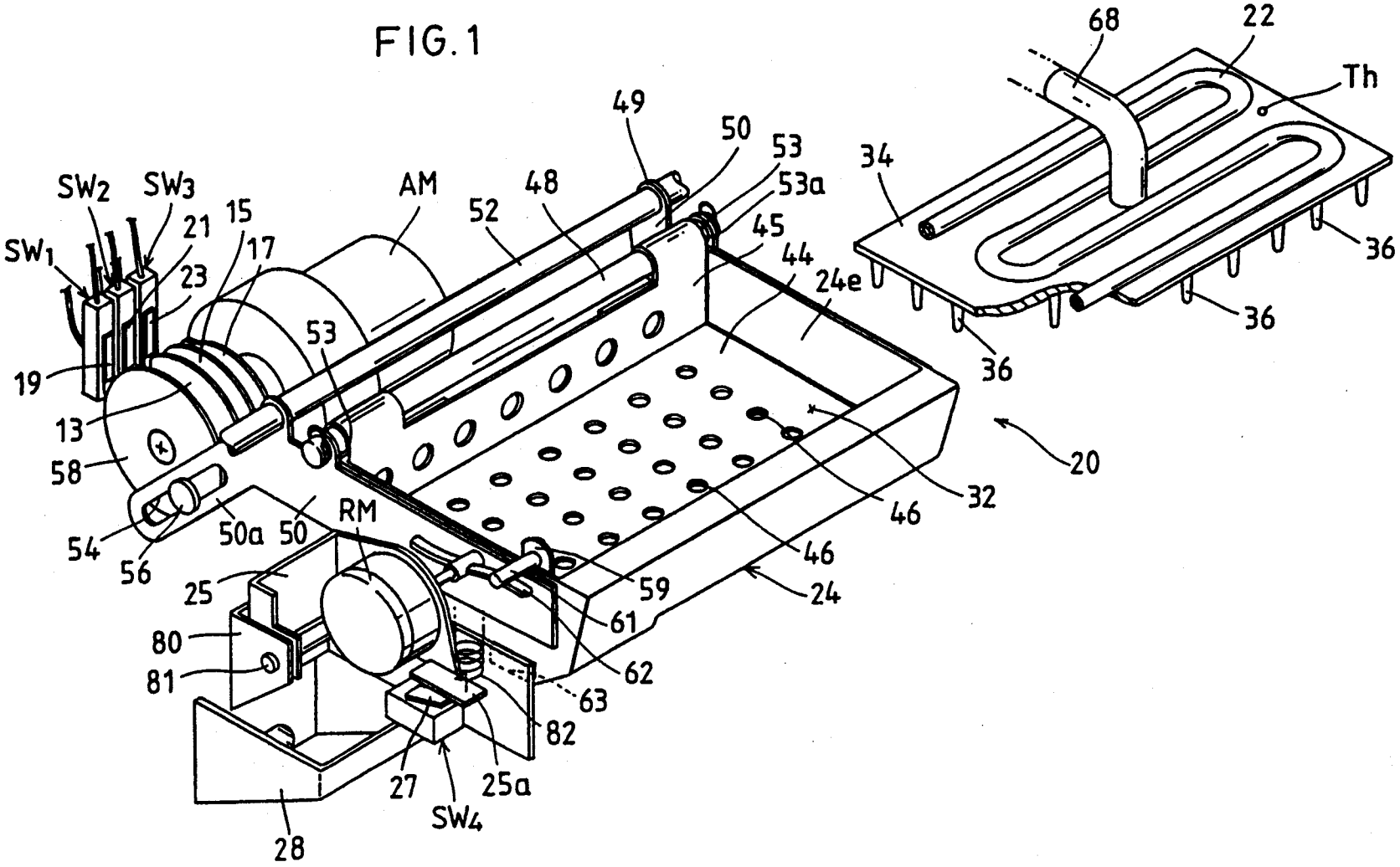
FIG. 1 shows schematically in exploded perspective view a freezing unit of an ice making machine, in which the detection mechanism according to a first embodiment of this invention is employed.
Figure 5:
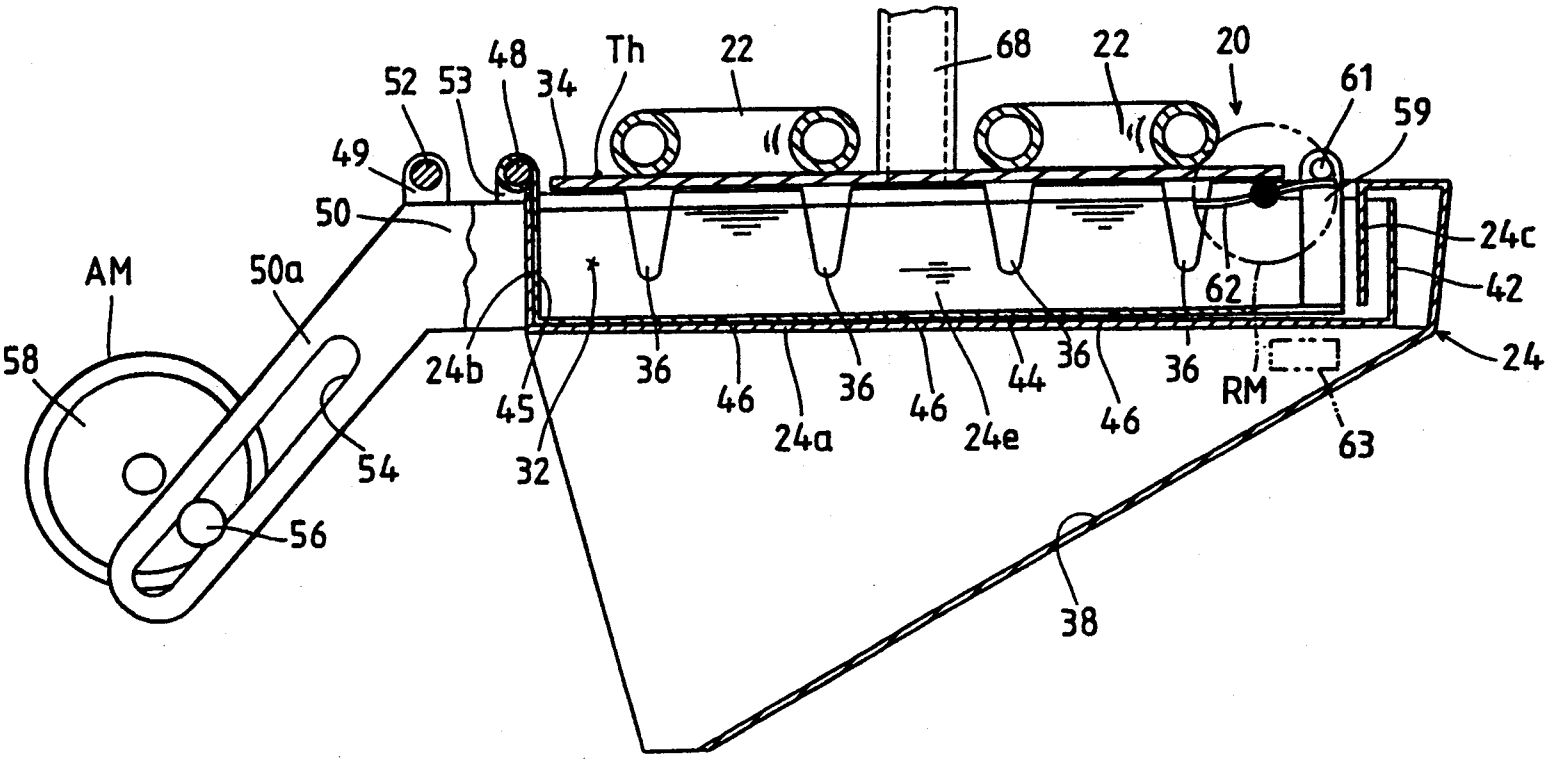
FIG. 5 shows in vertical section the major portion of the freezing unit.
Figure 6:
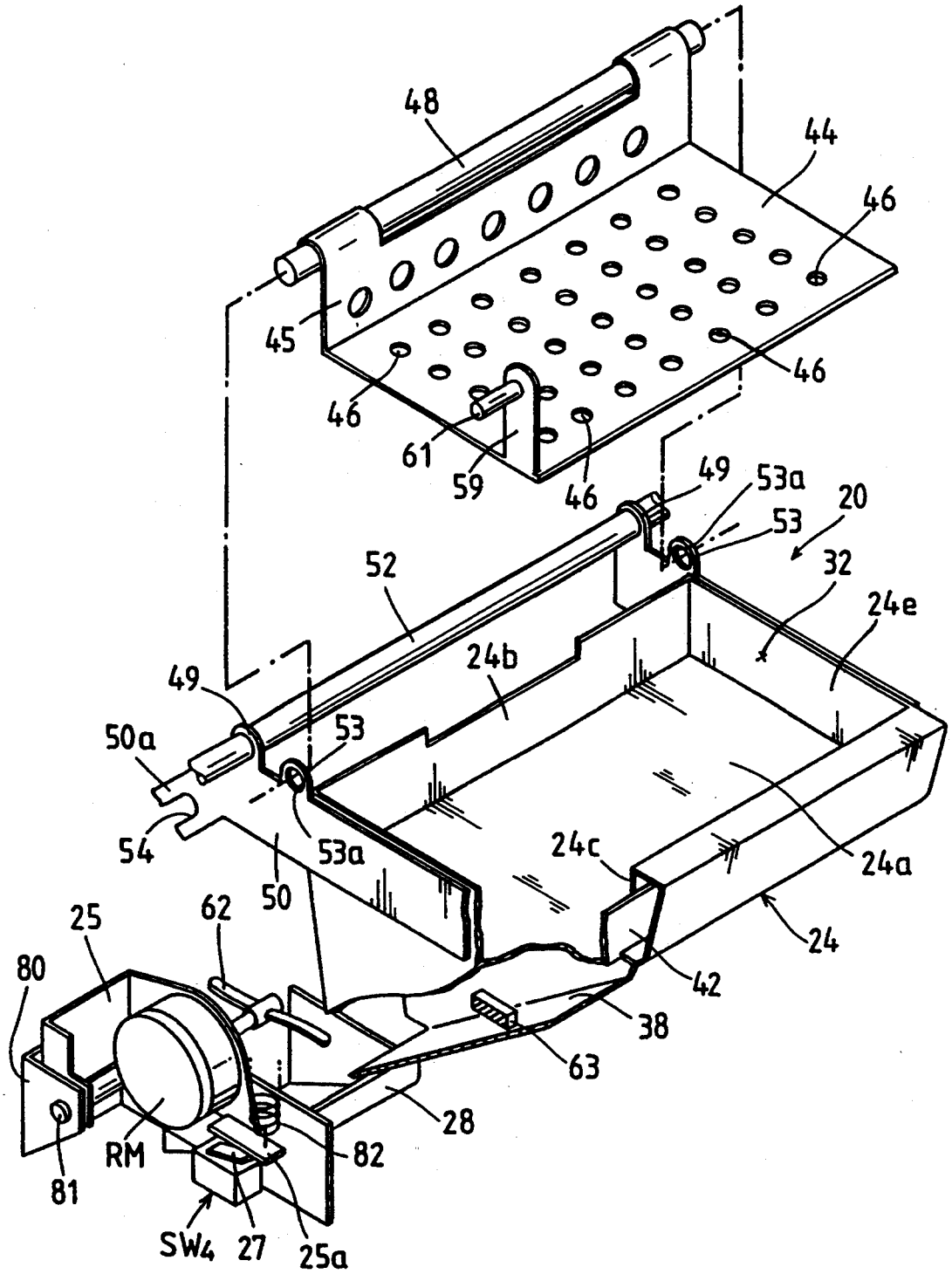
FIG. 6 shows in partially cut-away perspective view a water tray, a rocking plate to be incorporated therein and a drainage for discharging the water to be frozen.
Figure 13:
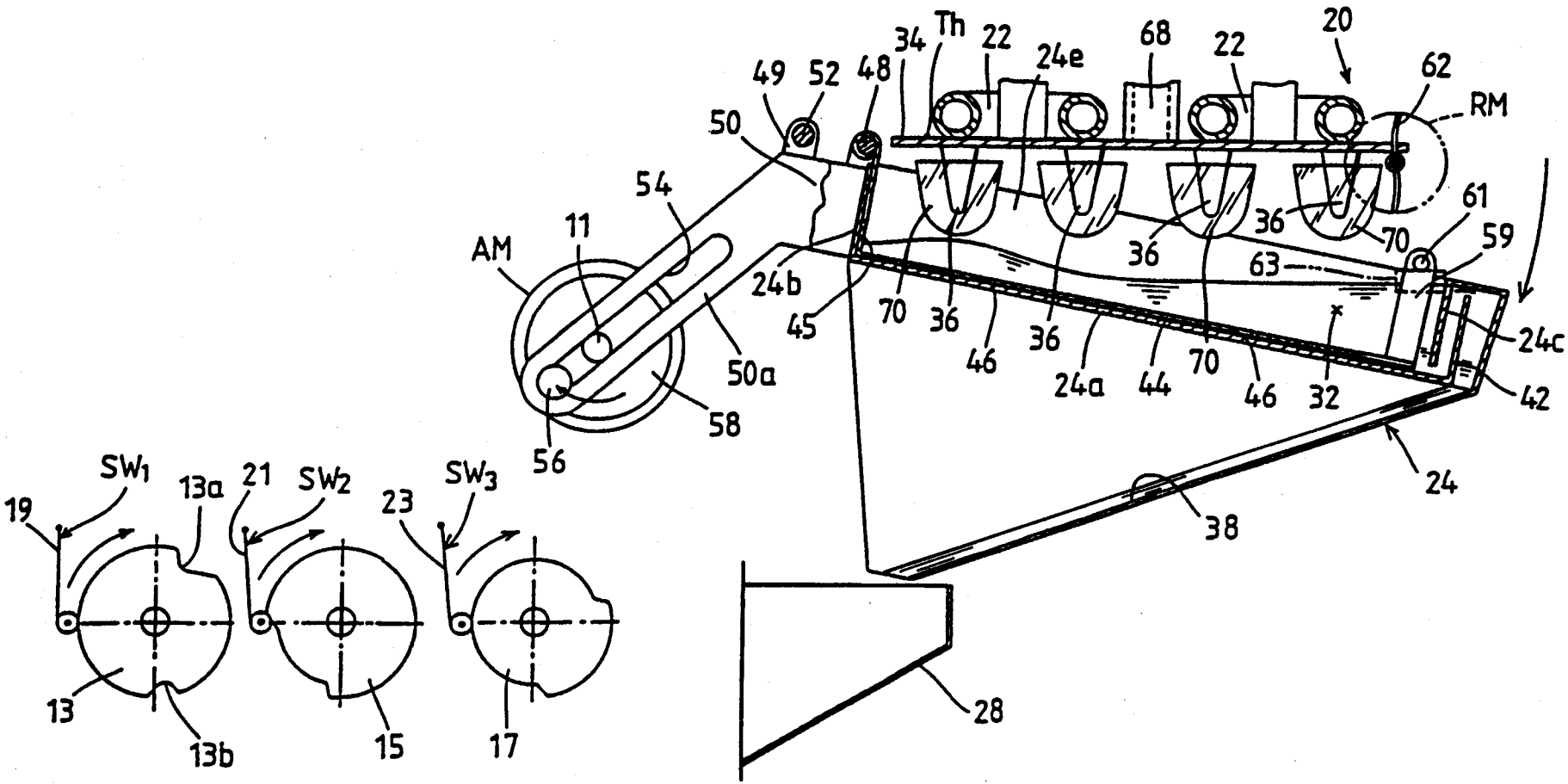
FIG. 13 shows in vertical section the freezing unit, where the water tray is tilting, and the water remaining therein is being partly discharged.
Figure 14:
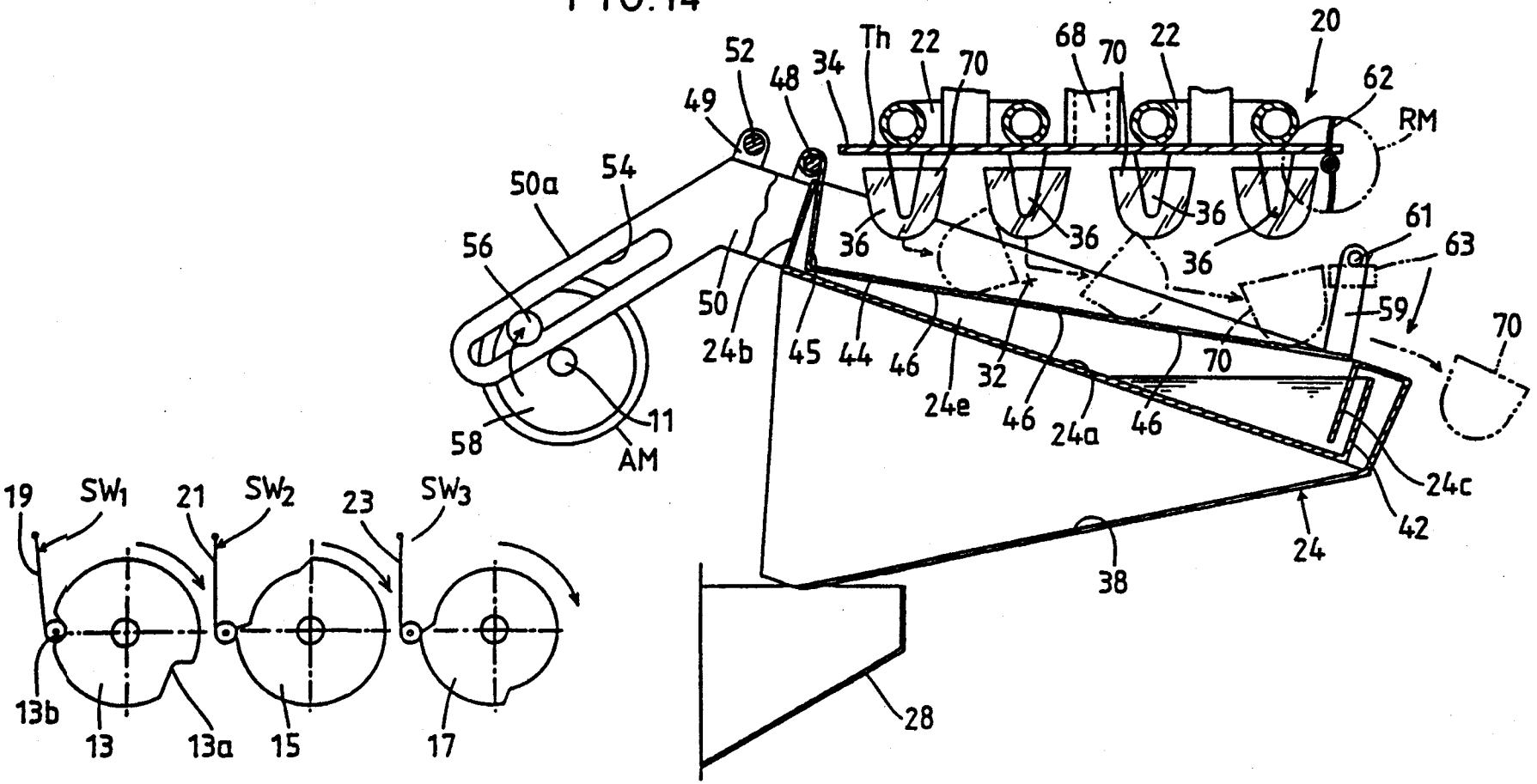
FIG. 14 shows in vertical section the freezing unit, where the water tray is stopping in the tilted posture, and the ice pieces are being released while the rocking plate is retained in a tilted posture at a position slightly above the water tray.
Figure 15:
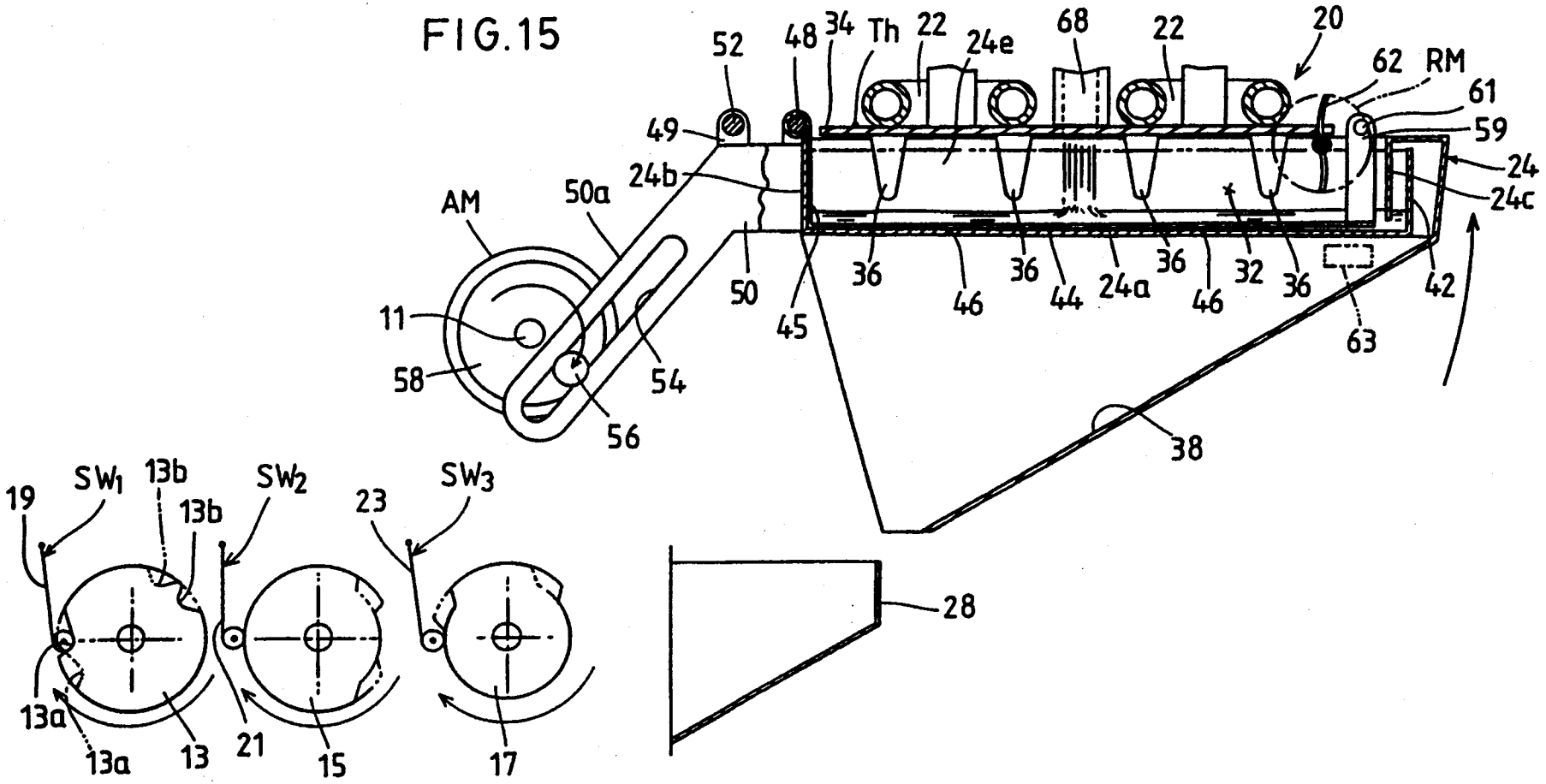
FIG. 15 shows in vertical section the freezing unit, where the water tray is reset to the original horizontal posture, and water to be frozen is supplied afresh to the residual water.

FIG. 5 shows minutely a vertical sectional view of the freezing unit 20, in which the water tray 24, the structure of which is as shown in FIGS. 1 and 6, is designed to carry a predetermined level of water to be frozen in the freezing chamber 32 defined therein. In other words, the freezing chamber 32 is defined by a rectangular bottom **24*a* of the water tray 24 and four walls 24*b*, 24*c*, 24*d*, 24*e* standing upright from the four sides of the rectangular bottom 24*a*, respectively. A pair of supporting members 50 are fixed to the outer surfaces of the shorter walls 24*d*, 24*e* opposing to each other. As shown in FIG. 6, the supporting member 50 fixed to the wall 24*d* has a cam portion 50*a* bending diagonally downward at a position outer than the water tray 24, and a cam slot 54 is defined in the cam portion 50*a*, in which a cam follower 56 formed eccentrically on a cam disc 58 (to be described later) is fitted slidably. A tongue 49 having a through hole is formed adjacent to the corner of the bent portion in each supporting member 50 at a position outer than the water tray 24, and a pivotal shaft 52 is inserted to these through holes. The pivotal shaft 52 is fixed to the main body of the ice making machine, so that the water tray 24 may be tilted downward or reset to the horizontal posture on the pivotal shaft 52 under the cam action with the rotation of an actuator motor AM connected to the cam disc 58, as shown in FIGS. 13 to 15**.

(Freezing system)

Figure 9:
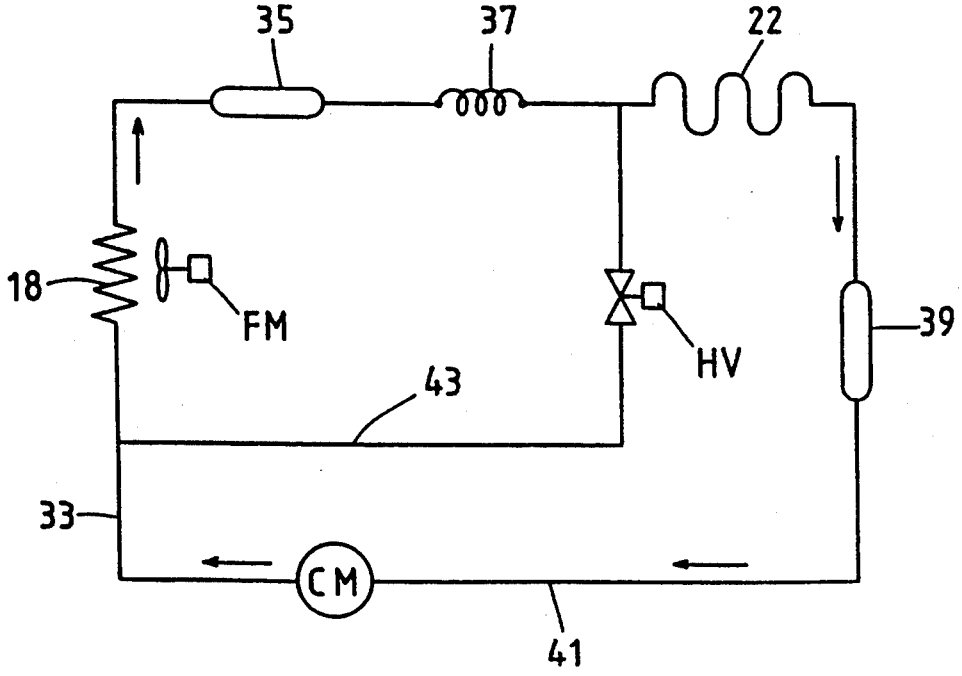
FIG. 9 shows schematically a freezing system to be employed in the ice making machine.

FIG. 9 shows a schematic constitution of the freezing system to be employed in the ice making machine. The cooling medium vaporized under compression by the compressor CM is passed through a delivery pipe 33, liquefied by the condenser 18 and, after desiccation in a dryer 35, decompressed through a capillary 37. The thus treated cooling medium then flows into an evaporator 22 to be allowed to expanded suddenly to carry out heat exchange with the freezing base plate 34 and cool the freezing fingers 36 below the freezing point. The portion of the cooling medium vaporized in the evaporator 22 and the unvaporized portion of the cooling medium flow into an accumulator 39 in the form of gas-liquid mixture, where they are separated into the respective phases. The gaseous phase cooling medium is recirculated to the compressor CM through a suction pipe 41, while the liquid phase cooling medium is accumulated in the accumulator 39. Further, a hot gas pipe 43 branching out of the delivery pipe 33 of the compressor CM is connected to the inlet side of the evaporator 22 through a hot gas valve HV. The hot gas valve HV is open during the ice releasing operation to bypass the heated medium (hereinafter referred to as hot gas) delivered from the compressor CM through the evaporator 22 via the hot gas pipe 43 to heat the freezing fingers 36 and allow the ice pieces to drop by their own weights. Meanwhile, the hot gas delivered from the evaporator 22 heats the liquid phase cooling medium staying in the accumulator 39 to vaporize it, and the thus vaporized cooling medium is recirculated to the compressor CM through the suction pipe 41. Incidentally, the reference mark FM denotes a fan motor for the condenser 18.

(Water discharging mechanism of water tray)

As shown in FIGS. 5 and 6, the water tray 24 has a drainage for discharging the water remaining in the freezing chamber 32 whenever the water tray 24 is tilted. More specifically, a water chute 38 is integrally formed on the bottom of the water tray 24 to extend diagonally downward therefrom, and a water collecting section 28 for discharging the thus collected water to the outside of the machine is defined in the ice bin 12 at an upper position (see FIG. 7). As shown in FIG. 5, the one longer wall on the free end side of the water tray 24 (locating opposite to the pivotal shaft 52) constitutes a dam plate 42, and an inner wall **24*c* covering the dam plate 42 is integrally formed with the water tray 24. Incidentally, the lower free end of the inner wall 24*c* is positioned adjacent to the bottom of the water tray 24 with a very small clearance therebetween. Accordingly, as shown in FIG. 5, the water to be frozen flows through the lower free end of the inner wall 24*c* to the dam plate 42, and flows further over the dam plate 42 to be discharged to the water chute 38. In other words, the water to be frozen to be carried in the freezing chamber 32 can be maintained at a predetermined level by the dam plate 42**.

Upon switching to the ice releasing operation (to be described later), the water tray 24 is tilted downward 24, as shown in FIG. 13, to discharge the water remaining therein through the water chute 38. When the water tray 24 is stopped in the tilted posture, a part of the freezing water is held by the dam plate 42 to remain therein (see FIG. 14). The residual water is combined with another portion of water to be frozen supplied afresh from a water supply pipe 68 to cool effectively the temperature of the water to be frozen entirely.

Figure 12:
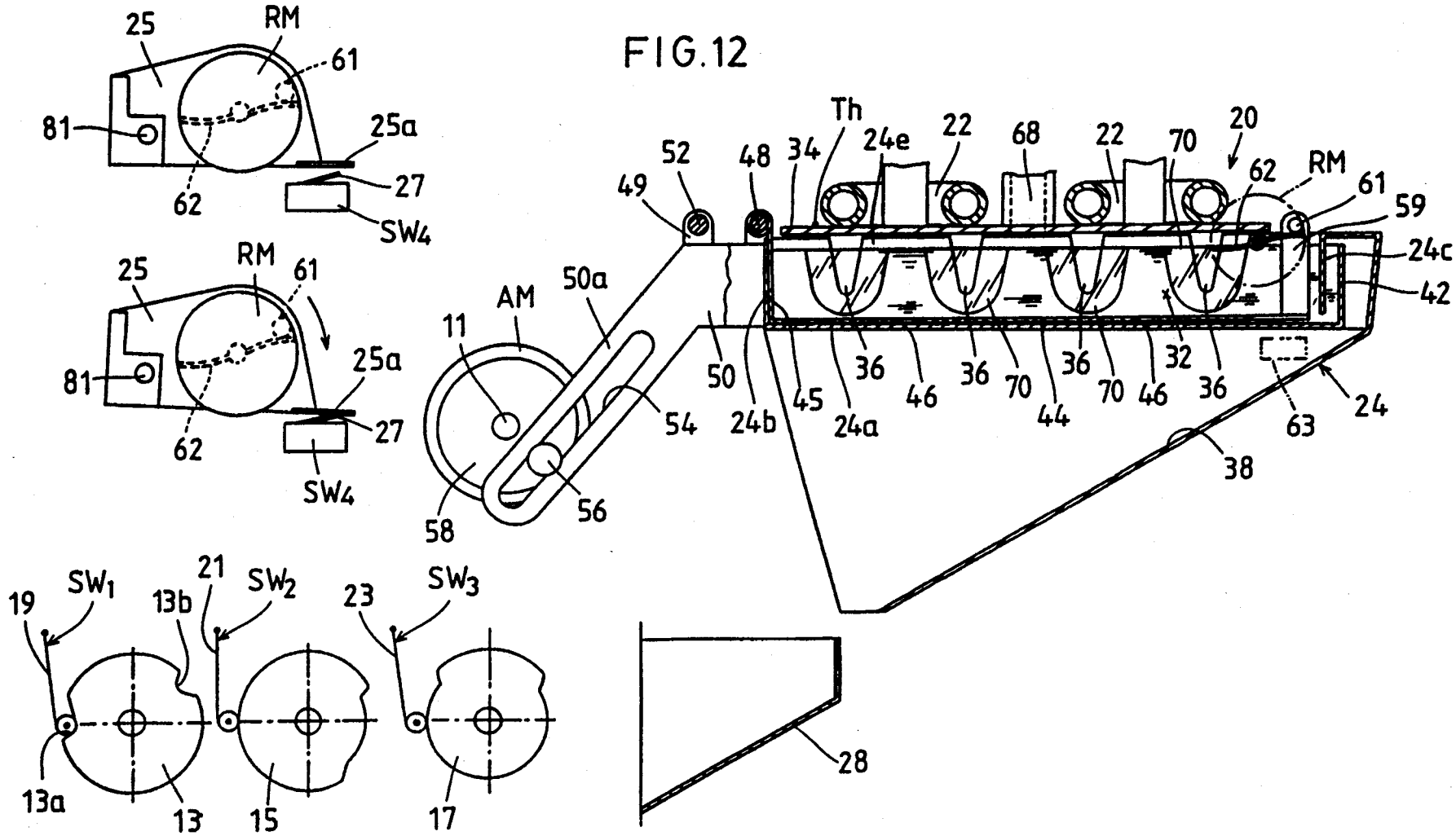
FIG. 12 shows in vertical section a state where ice formation is completed in the freezing unit, together with the positional relationship between a rocking motor and the ice formation completion detection switch and that between a cam follower and a cam slot.

The freezing base plate 34 is secured horizontally at an upper position of the rectangular housing 10, and the evaporator 22 led out of the freezing system housed in the machine chamber 14 is disposed zigzag on the upper surface of the freezing base plate 34. Meanwhile, a plurality of freezing fingers 36 protrude downward from the lower surface of the freezing base plate 34 at predetermined intervals, and these freezing fingers 36 are adapted to be dipped in the water to be frozen carried in the water tray 24 during the freezing operation. As heat exchange with the cooling medium in the evaporator 22 is proceeded by operating the freezing system, the freezing fingers 36 are cooled and maintained at a temperature of 0° C. or lower to allow ice pieces 70 to grow gradually around the freezing fingers 36, as shown in FIG. 12.

(Cam control mechanism)

Figure 2:
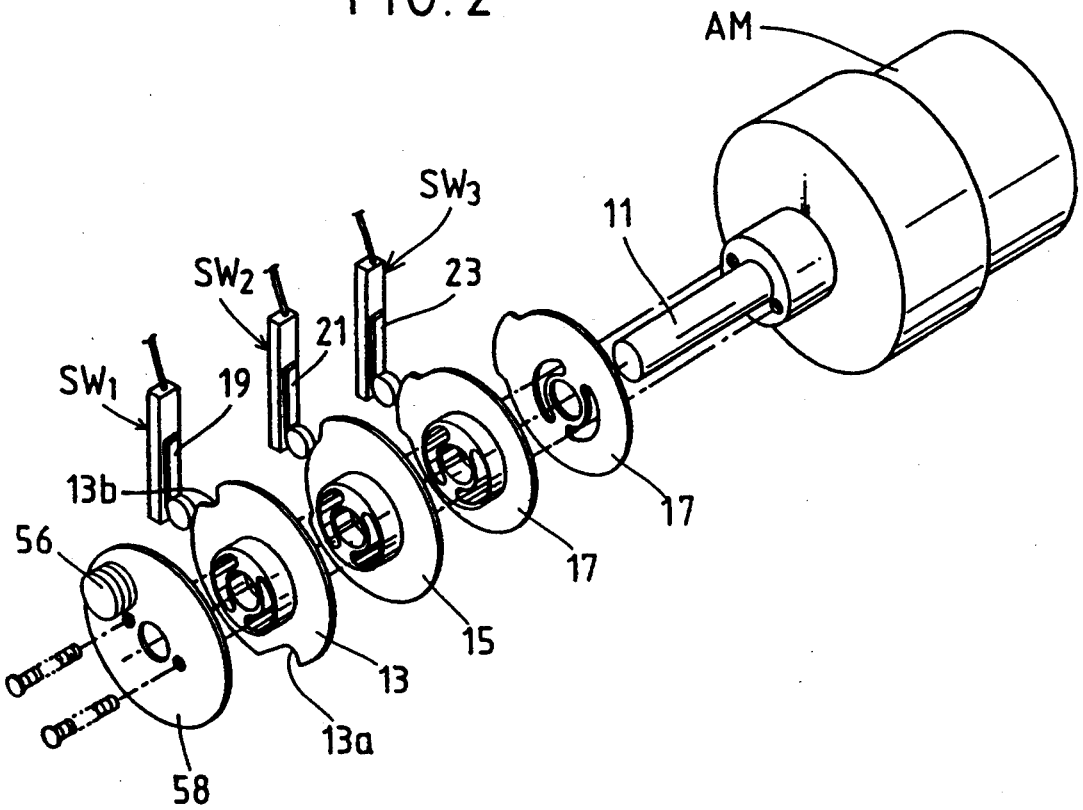
FIG. 2 shows schematically a perspective view of a cam control mechanism to be employed in said ice making machine.
Figure 2:
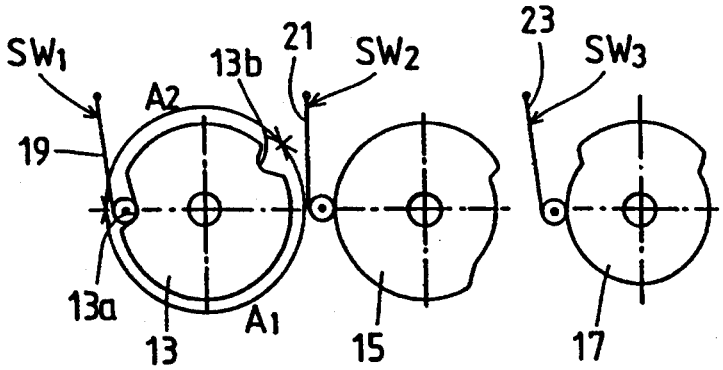

As shown in FIG. 2, a first cam 13, a second cam 15 and a third cam 17 are disposed coaxially to the rotary shaft 11 of the actuator motor AM at predetermined intervals. Meanwhile, a first switch $SW_1$, a second switch $SW_2$ and a third switch $SW_3$ are fixed to the main body of the ice making machine, and cam actions are designed to be added to the rotation of the actuator motor AM so as to control the following motions to be caused by the operation of the actuator motor AM:

(1) tilting or reselling of the water try 24 and stopping it at such postures;

(2) opening and closing of the hot gas valve HV; and (3) opening and closing of the water valve WV for supplying water to be frozen, respectively. More specifically, the first cam 13 assumes a form of disc with a predetermined diameter having a couple of recesses 13*a*, 13*b* formed on the circumference thereof, and the roller of a lever 19 extending from the first switch $SW_1$ is designed to be abutted against the circumference of the first cam 13 and engaged with the recess 13*a* or 13*b* in accordance with a predetermined timing. These recesses 13*a*, 13*b* are not formed symmetrically on each side of the center of the cam with 180° angles but with a predetermined central angle therebetween, as shown in FIG. 2. Provided that the circumferential section formed between the recesses 13*a*, 13*b* with a larger central angle is to be referred to as $A_1$, while the circumferential section formed therebetween with a smaller central angle is to be referred to as $A_2$, the circumferential section $A_1$ assumes the cam surface for controlling tilting of the water tray 24, and the circumferential section $A_2$ assumes the cam surface for controlling resetting of the water tray 24 to the horizontal posture, as will be described later. The first switch $SW_1$ is connected to a first relay $X_1$ in the control circuit shown in FIG. 3 to control tilting and resetting of the water tray 24 and stopping thereof at such postures. The timing of the cam actions between the first cam 13 and the first switch $SW_1$ is as shown in the timing chart of FIG. 4.

Figure 3:
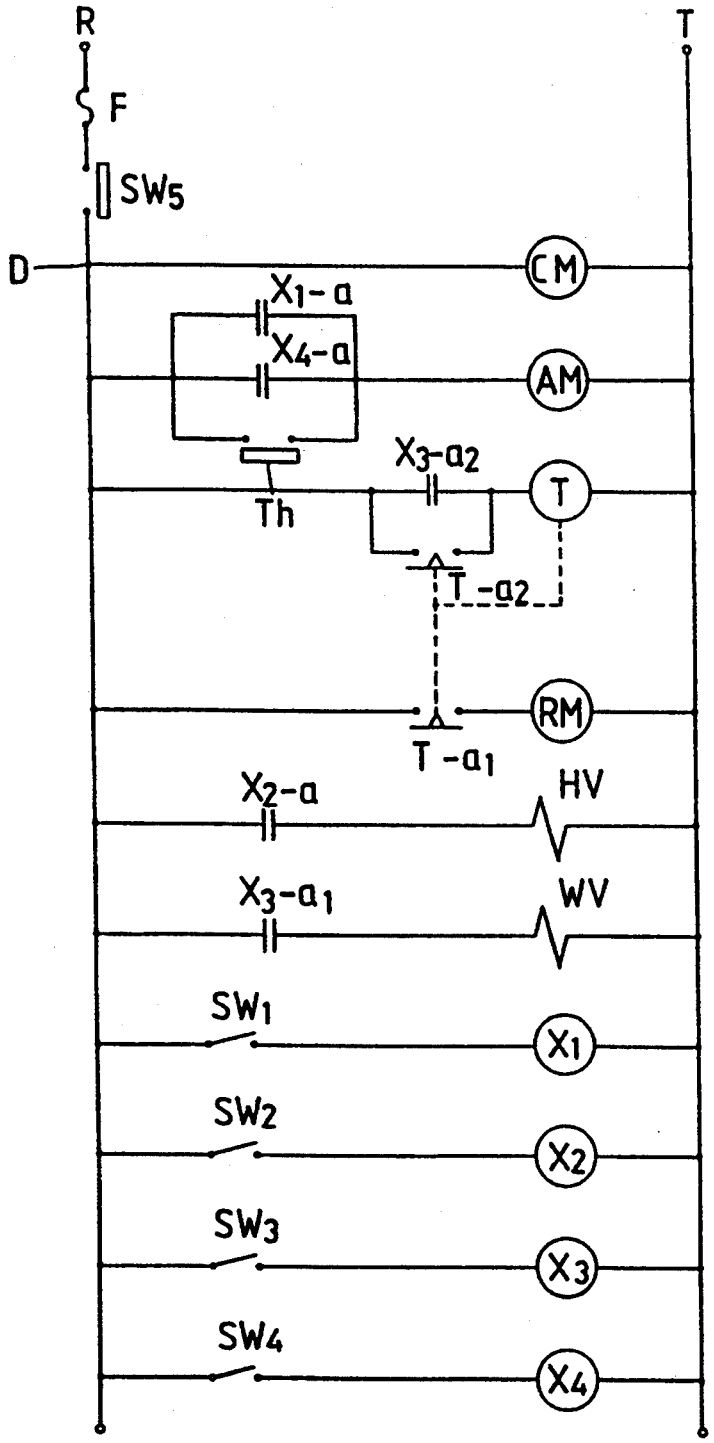
FIG. 3 shows a diagram of control circuit connected to the cam control mechanism.

The second cam 15 also assuming a form of disc has a circumferential section having a central angle of about 270° and the roller of a lever 21 extending from the second switch $SW_2$ is designed to be abutted against the circumference of the cam 15 and engaged with the recess having a central angle of about 90° in accordance with a predetermined timing. The second switch $SW_2$ is connected to a second relay $X_2$, as shown in FIG. 3, and controls opening and closing of the hot gas valve HV in cooperation with the opening and closing of a normally open contact $X_2$-a (as will be described later). The third cam 17 has a circumferential cam surface having a central angle of about 90°, and the roller of a lever 23 extending from the third switch $SW_3$ is designed to be abutted against the circumference of the third cam 17. The third switch $SW_3$ is turned on when the lever 23 of the third switch is abutted against the cam surface. The third switch $SW_3$ is connected to a third relay $X_3$, as shown in FIG. 3, and controls opening and closing of the water valve WV interlocking with a normally open contact $X_3$-$a_1$ (as will be described later). Timing of the cam actions between the second cam 15 and the second switch $SW_2$ and that between the third cam 17 and the third switch $SW_3$ will be shown in the timing chart of FIG. 4.

(Rocking plate)

An L-shaped rocking plate 44 is disposed in the freezing chamber 32 defined in the water tray 24 so as to be able to be rocked freely therein by the rotation of the rocking motor RM. More specifically, the rocking plate 44 is of a planar plate having a vertical portion 45 and also a plurality of through holes 46 defined at predetermined intervals thereon, as shown in FIG. 6. The circumferential size of the rocking plate 44 is designed to be slightly smaller than the inner circumferential size of the bottom 24*a* of the freezing chamber 32, and the upper end portion of the vertical portion 45 is rolled outward to form through holes on each side, in which a rocking shaft 48 is inserted. The end portions of the rocking shaft 48 is designed to be fitted into the through holes 53*a* of tongues 53 formed on the outer surfaces of the side walls of the water tray 24. With the rocking plate 44 pivotally supported by the rocking shaft 48, the rocking plate 44 is brought into intimate contact with the bottom of the freezing chamber 32, as shown in FIG. 5.

Figure 10:
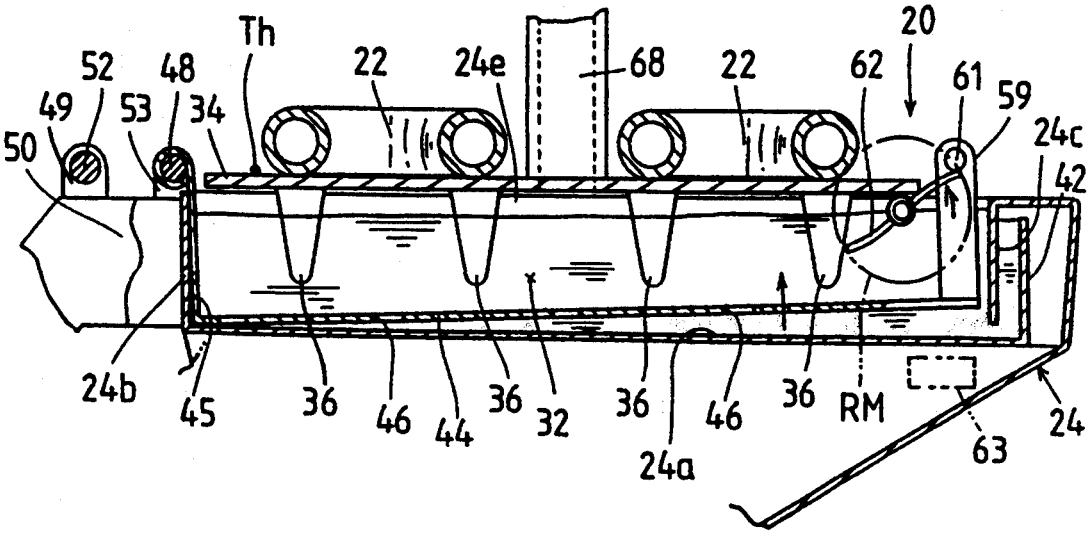
FIG. 10 shows in vertical sect ion the major portion of the freezing unit, where the rocking plate is ascended.
Figure 11:
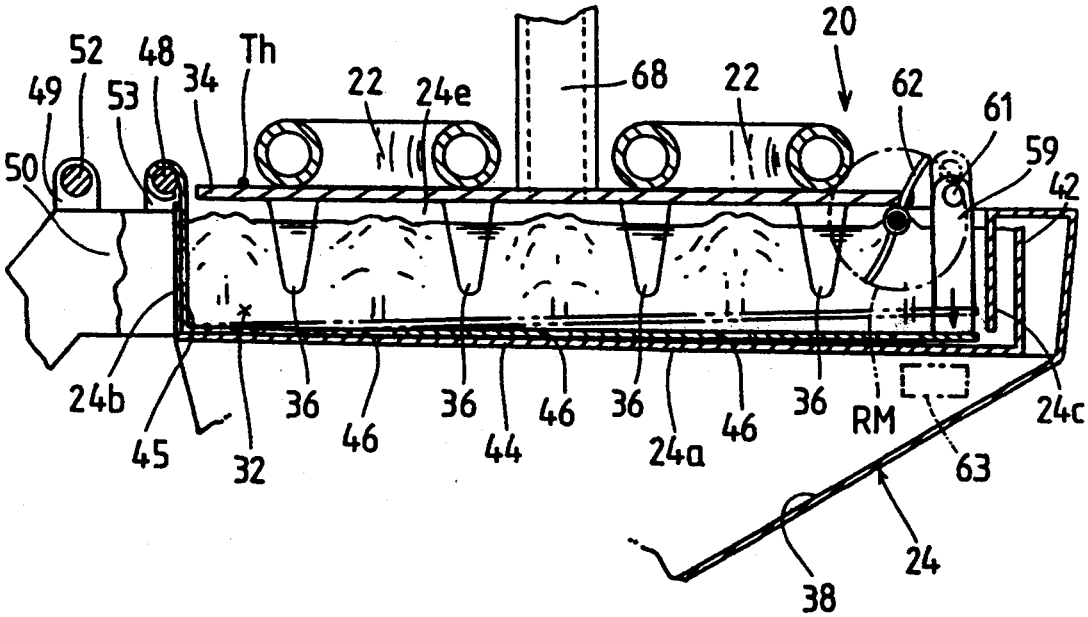
FIG. 11 shows in vertical sect ion the major portion of the freezing unit, where the rocking plate is descended.

As shown in FIG. 6, the rocking plate 44 also has formed integrally therewith a vertical tongue 59 on one shorter edge thereof, and an engagement pin 61 extends outward horizontally therefrom. Meanwhile, as shown in FIGS. 1 and 6, the rocking motor RM is disposed on the inner wall surface of the main body of the ice making machine in such a way that it can be pivoted slightly as will be described later. An engagement piece 62 protruding from the rotary shaft of the motor RM is designed to be engageable with the engagement pin 61 of the rocking plate 44 locating above the engagement piece 62. Accordingly, by rotating the rocking motor RM counterclockwise, the engagement piece 62 is rotated under engagement with the engagement pin 61 to lift the rocking plate 44 from the bottom of the freezing chamber 32 to a predetermined height, as shown in FIG. 10, and then allow it to drop onto the bottom of the freezing chamber 32 by its own weight upon disengagement of the engagement piece 62 from the engagement pin 61, as shown in FIG. 11. Namely, the rocking plate 44 repeats such rocking motion in the freezing chamber 32 on the rocking shaft 48 by rotating the rocking motor RM during the freezing operation, whereby the water to be frozen can constantly be agitated. Incidentally, since the rocking plate 44 has through holes 46, the water to be frozen flows through these through holes 46 upward and downward, whereby agitation of the water to be frozen can further be accelerated. However, these through holes 46 are not inevitable, but can be omitted, as desired. Further, while the rocking plate 44 is designed to be tilted as the water tray 24 is tilted before the ice releasing operation (to be described later) is started, a stopper 63 extending horizontally from the rectangular housing 10 is disposed on the tilting orbit of the engagement pin 61 provided on the rocking plate 44. By allowing the engagement pin 61 to engage with the stopper 63 during the process that the rocking plate 44 is tilted together with the water tray 24, the rocking plate 44 is separated from the water tray 24 and assumes there a predetermined tilted posture.

(Fitting structure of rocking motor RM)

As shown in FIGS. 1 and 6, a metal fitting 80 is secured to that inner wall surface of the main body of the ice making machine on which the engagement pin 61 of the rocking plate 44 is disposed, and a fixture 25, on which the rocking motor RM is mounted, is pivotally supported onto the metal fitting 80 through a pivotal shaft 81. An actuation piece 25*a* is formed on the fixture 25 on the right side (in terms of FIGS. 1 and 6) of the rocking motor RM, on which a tension spring 82 is disposed in such a way that it may normally urge the fixture 25 counterclockwise on the pivotal shaft 81, so that the fixture 25 can be turn ed by a predetermined angle on the pivotal shaft 81 when a predetermined external force is applied to the rocking motor RM. Incidentally, the torsion spring 82 functions to normally retain the rocking motor RM at the operational position where the engagement piece 62 provided on the rotary shaft thereof can be engaged with the engagement pin 61 of the rocking plate 44, as well as, to reset the rocking motor RM to the operational position after the rocking motor RM is turned by the external force to be subject to no external force any more.

(Switch $SW_4$ for detecting completion of ice formation and switch Th for detecting completion of ice releasing operation)

A switch $SW_4$ such as a microswitch for detecting completion of ice formation is disposed on the metal fitting 80 with the lever 27 of the switch $SW_4$ being on the turning orbit of the actuation piece 25*a* so as to be able to be abutted against the actuation piece 25*a* as the fixture 25 (rocking motor RM) is pivoted and turn on the switch $SW_4$. Namely, as will be described later referring to FIG. 12, when ice pieces 70 are formed around the freezing fin gets 36 as the freezing operation proceeds, the rocking plate 44 is brought into contact with these ice pieces 70 in its upward stroke to exert a downward counterforce to the rocking motor RM through the engagement piece 62. Accordingly, the fixture 25 having mounted thereon the rocking motor RM is pivoted clockwise on the pivotal shaft 81 and allows the actuation piece 25*a* thereof to depress the lever 27 of the switch $SW_4$ in its pivoting process to turn on switch $SW_4$, and thus completion of ice formation in the freezing unit 20 is detected. Meanwhile, as shown in FIGS. 1 and 5, a thermometal switch Th for detecting completion of ice releasing operation is disposed on the upper surface of the freezing base plate 34 in the freezing unit 20, which is turned on by the sudden temperature rise caused by the dropping off of the ice pieces 70 from the freezing fingers 36 to rotate the actuator motor AM.

(Example of electric control circuit)

FIG. 3 shows an electric control circuit in the ice making machine according to the first embodiment of the invention, in which a fuse F and a switch $SW_5$ for detecting ice fullness are interposed in series between a power supply line R and a joint D, and a compressor CM is interposed between the joint D and a line T. Likewise, (1) a first switch $SW_1$ for the actuator motor AM shown in FIG. 2 and a relay $X_1$; (2) a second switch $SW_2$ for supplying hot gas shown in FIG. 2 and a second relay $X_2$; (3) a third switch $SW_3$ for supplying water to be frozen shown in FIG. 2 and a relay $X_3$; and (4) a switch $SW_4$ for detecting completion of ice formation shown in FIG. 1 and a relay $X_4$ are interposed in series respectively between the joint D and the line T. Meanwhile, a timer (T) for controlling timing of driving the rocking motor RM is also interposed, with one terminal thereof being connected to the line T, while the other terminal being connected to the joint D through a normally open contact $X_3$-$a_2$ of the relay $X_3$. Incidentally, a second normally open contact T-$a_2$ for the timer (T) is disposed in parallel to the normally open contact $X_3$-$a_2$ to achieve self-hold thereof.

One terminal of the actuator motor AM is connected to the line T, while the other terminal thereof is connected to the joint D through the elements connected in parallel: (1) a normally open contact $X_4$-a for the relay $X_4$; (2) an $X_1$-a for the relay $X_1$; and (3) the thermometal switch Th for detecting completion of ice releasing operation. Between the joint D and the line T are also interposed in series respectively (1) the rocking motor RM and a first normally open contact T-$a_1$ for the timer (T); (2) the hot gas valve HV and the $X_2$-a for the second relay $X_2$; and (3) the waver valve WV for supplying water to be frozen and the normally open contact $X_3$-$a_1$ for the relay $X_3$.

Figure 4:
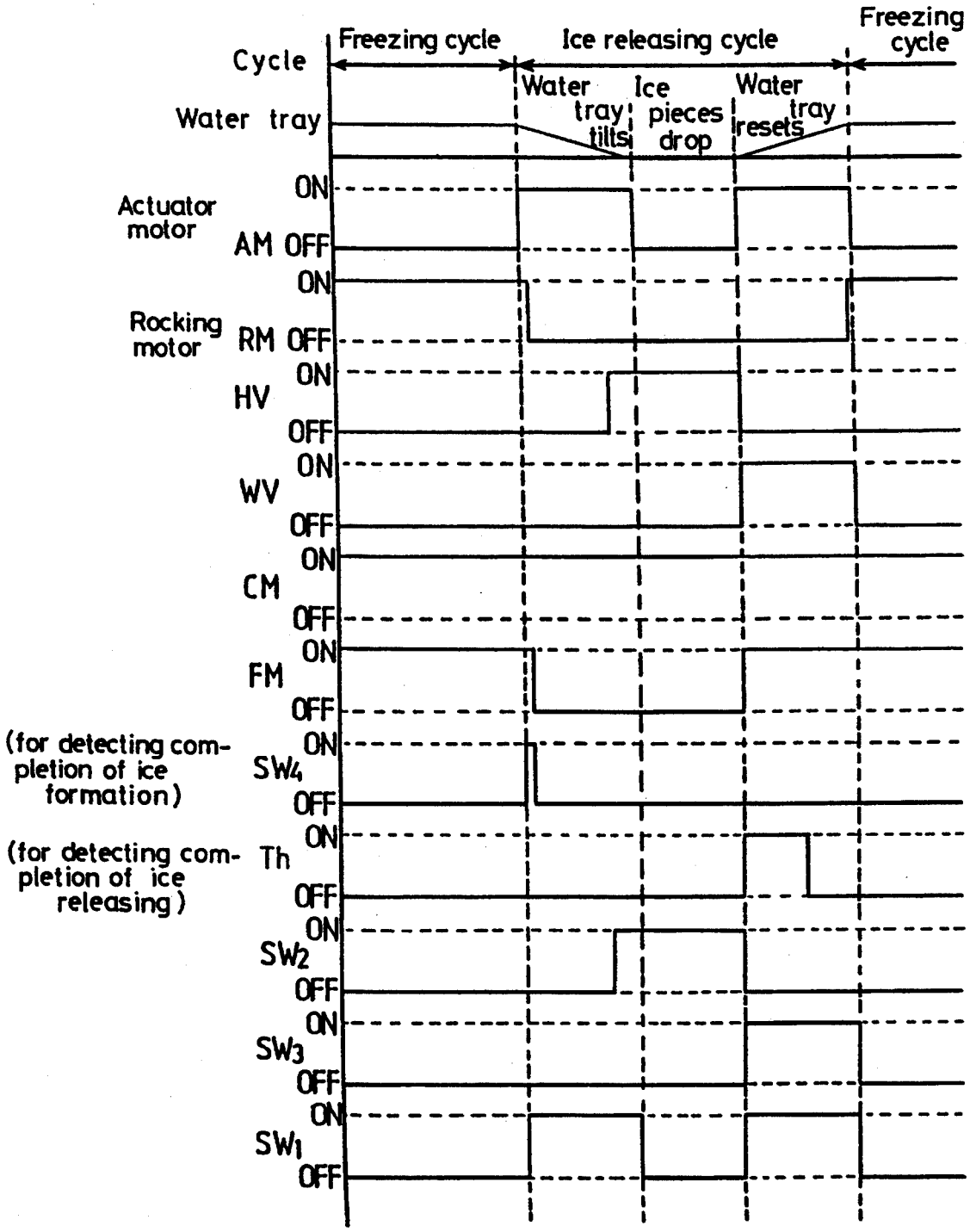
FIG. 4 shows a timing chart of the control to be effected by the cam control mechanism.

Next, the actions of the ice making machine employing the detection mechanism according to the first embodiment of the invention will be described referring to the timing chart shown in FIG. 4. Before the freezing operation is started, the water tray 24 is maintained in a horizontal posture, as shown in FIG. 5, and water to be frozen is supplied to the freezing chamber 32 defined in the water tray 24 through the water supply pipe 68. Feeding and stopping of the water from the water supply valve 68 is carried out by controlling opening and closing of the water valve WV by the cam action between the third cam 17 and the third switch $SW_3$. Even if an excess amount of water should be supplied to the freezing chamber 32, the excess portion of water flows over the dam plate 42 and discharged to the outside of the machine through the water chute 38 and the water collecting section 28, as described above.

A cooling medium is supplied to the evaporator 22 from the circulation pipe of the freezing system, and cooling of the freezing fingers 36 formed on the freezing base plate 34 is started by the heat exchange action of the cooling medium. Since the freezing fingers 36 are dipped in the water to be frozen, the water starts to freeze around the freezing fingers 36 and grows gradually into inverted dome-shaped ice pieces 70, as shown in FIG. 12. During such freezing operation, the rocking motor RM is continuously rotated, the rotational timing of which is set by the timer (T). Accordingly, the engagement piece 62 provided on the rotary shaft of the motor RM is engaged with the engagement pin 61 provided on the vertical tongue 59 to lift the rocking plate 44, as shown in FIG. 10. Upon disengagement of the engagement piece 62 from the engagement pin 61, the rocking plate 44 drops by its own weight and is abutted against the bottom 24*a* of the freezing chamber 32, as shown in FIG. 11. Thus, the rocking plate 44 repeats such rocking motion in the water to be frozen in the freezing chamber 32 during the freezing operation to constantly agitate the water. Morever, since through holes 46 are formed on the rocking plate 44, the water to be frozen flows through these through holes 46 as the rocking plate 44 is rocked to cause jet streams which further accelerate the agitation of the water to be frozen. Since the water to be frozen is constantly maintained in a dynamic state, as described above, opacification to white of the ice pieces 70 to be formed around the freezing fingers 36 can be prevented, and transparent and clear ice pieces 70 can be obtained.

As shown in FIG. 12, upon formation of inverted dome-like ice pieces 70 fully around the freezing fingers 36, the rocking plate 44 is brought into contact with the ice pieces 70 in its upward stroke and finally exerts a downward counterforce to the rocking motor RM through the engagement pin 61 and the engagement piece 62. Accordingly, the fixture 25 having mounted thereon the rocking motor RM starts to make a clockwise turn on the pivotal shaft 81 to allow the actuation piece 25*a* of the fixture 25 to depress the lever 27 of the switch $SW_4$ for detecting completion of ice formation to turn on the switch $SW_4$, and thus completion of ice formation in the freezing unit 20 is detected. Whereupon the relay $X_4$ shown in FIG. 3 is actuated to close the normally open contact $X_4$-a which interlocks therewith and start rotation of the actuator motore AM. Thus, the cam disc 58 is turned clockwise to allow the cam follower 56 disposed eccentrically thereto to slide a long the cam slot 54 formed on the cam 50*a*, and thus the water tray 24 starts tilting downward. By this tilting motion of the water tray 24, the water remaining in the freezing chamber 32 flows along the inner wall 24*c* and over the dam plate 42 to the water chute 38, in turn, to the water collecting section 28. Incidentally, while the lever 19 of the first switch $SW_1$ shown in FIG. 2 is engaged with the recess 13*a* of the first cam 13 immediately before the actuator motor AM is rotated, the lever 19 rides on the circumferential section $A_1$ when the motor AM is started to turn on the switch $SW_1$. Thus, the relay $X_1$ is actuated to close the normally open contact $X_1$-a which inter locks therewith. Accordingly, the counterforce applied to the rocking motor RM is released by the tilting of the water tray 24, and the rotation of the actuator motor AM is continued by the closure of the normally open contact $X_1$-a even after the ice formation completion detection switch $SW_4$ is turned off.

Upon engagement of the lever 19 with the recess 13*b* of the first cam 13, the switch $SW_1$ is turned off to release actuation of the relay $X_1$ and open the normally open contact $X_1$-a which interlocks therewith. Accordingly, the water tray 24 stops at a predetermined angle, as shown in FIG. 14. In this state, while a portion of the water to be frozen remains in the freezing chamber 32 due to the presence of the dam plate 42, such residual water, fully cooled during the previous freezing operation, is mixed with another portion of water to be supplied afresh to cool effectively the thus combined water to be frozen. Meanwhile, the ice pieces 70 formed around the freezing fingers 36 are exposed as such by tilting the water tray 24. Further, since the rocking plate 44 is also tilted as the water tray 24 is tilted, the engagement pin 61 is disengaged from the engagement piece 62 of the rocking motor RM. In the process that the water tray 24 is stopped in the tilted posture, the engagement pin 61 of the rocking plate 44 is engaged with the stopper 63, as shown in FIG. 14, so that the rocking plate 44 is allowed to locate diagonally above the bottom 24*a* of the freezing chamber 32 in the water tray 24 which stops later in the tilted posture. The rocking plate 44 also functions as a chute for guiding the ice pieces 70 dropping from the freezing fingers 36 into the ice bin 12.

In the process of tilting the water tray 24, the lever 21 of the second switch $SW_2$ is engaged with the recessed circumferential section (with a central angle of about 90° of the second cam 15 (see FIG. 13) to turn on the switch $SW_2$ and actuate the second relay $X_2$ shown in FIG. 3. Whereupon the normally open contact $X_2$-a interlocking with the relay $X_2$ is closed to open the hot gas valve HV and supply a hot gas instead of the cooling medium to the evaporator 22 in accordance with the timing chart shown in FIG. 4. Thus, the freezing fingers 36 are heated rapidly through the freezing base plate 34. Accordingly, the bondage between the freezing fingers 36 and the ice pieces 70 is released, and the ice pieces 70 drop by their own weights, slide on the upper surface of the rocking plate 44 maintained in a predetermined tilted posture by the stopper 63 and are guided into the ice bin 12 locating below.

The negative temperature load applied to the freezing base plate 34 is released by the dropping of the ice pieces 70, and the temperature of the freezing base plate 34 is suddenly elevated by the passage the hot gas through the evaporator 22. This temperature rise is detected by the thermometal switch Th and turned on to allow the actuator motor to resume its rotation. Accordingly, the cam portion 50*a* is turned counterclockwise on the pivotal shaft 52 under the cam action of the cam disc 58, cam follower 56 and cam slot 54, to allow the water tray 24 to turn counterclockwise and start resetting to the horizontal posture. As the motor AM resumes rotation, the second cam 15 resumes rotation to allow the lever 21 extending from the second switch $SW_2$ to ride on the circumferential cam surface of the second cam 15 and turn off the switch $SW_2$. Thus, the actuation of the second relay $X_2$ shown in FIG. 3 is released to open again the normally open contact $X_2$-a which interlocks therewith and close the hot gas valve HV. Accordingly, supply of the cooling medium to the evaporator 22 is started again. Further, as the motor AM resumes rotation, the lever 23 of the third switch $SW_3$ is engaged with the circumferential cam surface of the third cam 17 to turn on the switch $SW_3$, whereby the third relay $X_3$ shown in FIG. 3 is actuated to close the normally open contact $X_3$-$a_1$ which interlocks therewith and open the water valve WV to supply water to be frozen to the freezing chamber 32. Upon disengagement of the third cam 17 from the third switch $SW_3$, the switch $SW_3$ is turned off to release actuation of the third relay $X_3$ to open the normally open contact $X_3$-$a_1$, as well as, to close the water valve WV and stop supply of water to be frozen.

Meanwhile, with the rotation of the actuator motor AM, the lever 19 of the first switch $SW_1$ engaged with the recess 13*b* of the first cam 13 rides on the cam surface on tile circumferential section $A_2$ to actuate the relay $X_1$ and open the normally open contact $X_1$-a, whereby the motor AM is energized in cooperation with the thermometal switch Th which is closed immediately after cooling of the freezing base plate 34 is resumed by supplying the cooling medium to the evaporator 22, as described above. Upon engagement of the lever 19 of the first switch $SW_1$ with the recess 13*a*, as the first cam 13 is rotated, the switch $SW_1$ is opened to release actuation of the relay $X_1$ and open the normally open contact $X_1$-a. Thus, the rotation of the actuator AM is stopped to allow the water tray 24 to stop in the horizontal posture.

Incidentally, when the third switch $SW_3$ for opening the water valve WV is turned on, the normally open contact $X_3$-$a_2$ which interlocks with the relay $X_3$ to energize the timer (T). After passage of a predetermined time period set in the timer (T), the first normally open contact T-$a_1$ which interlocks therewith is closed to start rotation of the rocking motor RM to allow the rocking plate 44 to resume its rocking motion during the freezing operation. Meanwhile, the second normally open contact T-$a_2$ of the timer (T) is closed to attain self-hold of the timer (T). After passage of the preset time period in the timer (T), the first and second normally open contacts T-$a_1$ and T-$a_2$ are opened to stop rotation of the rocking motor RM.

(General constitution of the ice making machine according to second embodiment)

Figure 17:
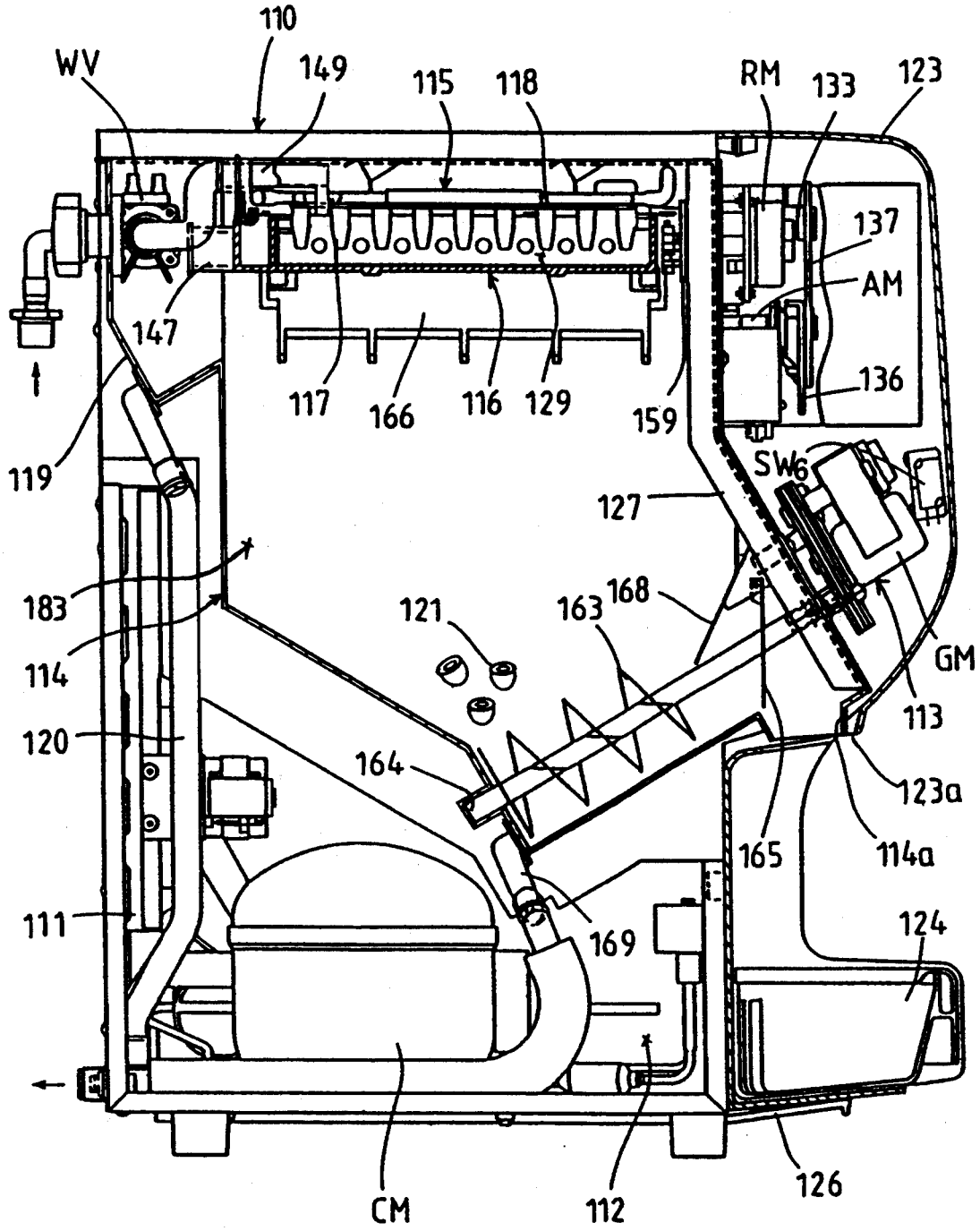
FIG. 17 shows schematically in vertical section the ice making machine in which the detection mechanism according to the second embodiment of the invention is employed.
Figure 23:
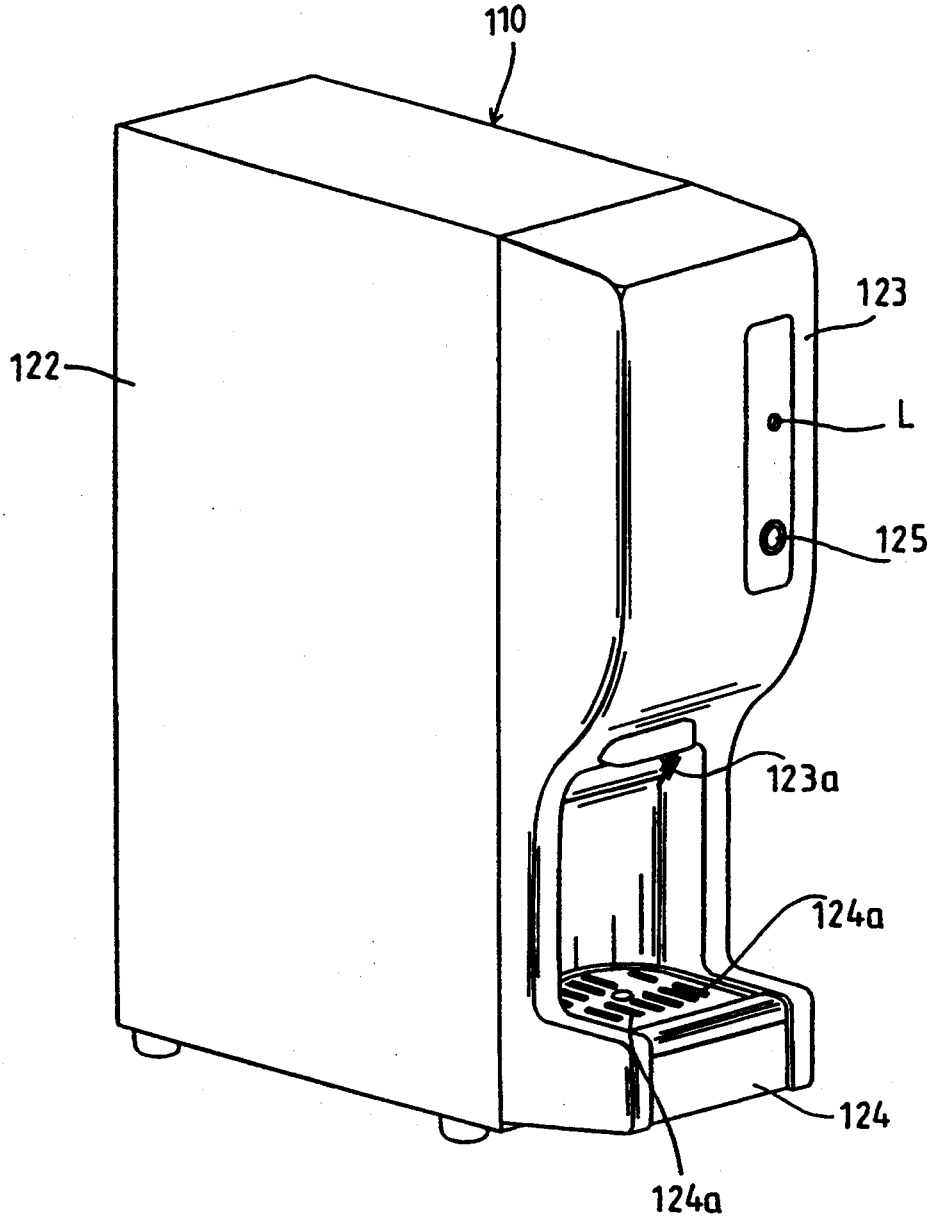
FIG. 23 shows in perspective view the appearance of the ice making machine.

FIGS. 17 and 23 show schematically, in cross section and perspective view, respectively the overall structure of the ice making machine in which the detection mechanism according to a second embodiment of the invention is employed. For convenience's sake, it should be appreciated that the expressions "front", "rear", "right" and "left" referred to herein are with respect to the front view of the ice making machine. A rectangular housing 110 constituting the main body of the ice making machine basically has defined therein a lower machine chamber 112 in which the freezing system including a compressor CM and a condenser 111 are housed, a box-like ice bin 114, disposed above the lower machine chamber 112, surrounded with a heat insulating material and having an ice chamber 183 defined therein, and a freezing unit 115 disposed in the ice bin 114 at an upper position thereof. As will be described later referring to FIGS. 18 and 19, the freezing unit 115 has a water tray 116 in which a predetermined level of water to be frozen is carried and a freezing base plate 118 having freezing fingers 117 to be dipped in the water to be frozen, wherein the water tray 116 is tilted to a predetermined angle upon switching to the ice releasing operation to discharge the water remaining in the water tray 116 to the outside of the machine through a water collecting section 119 and drain pipe 120 as well as to release the ice pieces 121 into the ice chamber 183. Incidentally, an ice discharging mechanism 113 (to be described later) is disposed to the ice bin 114, and the ice pieces 121 stored in the ice chamber 183 are adapted to be discharged thereby to the outside of the machine.

(Outer structure of rectangular housing)

As shown in FIG. 23, the rectangular housing 110 consists of a main frame 122 surrounding all of the members described above and a front panel 123 disposed to the front surface of the main frame 122, and assumes as a whole a slim body having a very narrow transversal size. The front panel 123 is made of a synthetic resin and formed into the shape as shown in FIG. 23, in which a downward opening **123*a* for discharging the ice pieces 121 defined in the ice bin 114 is formed around at the half height thereof to be in alignment with the outlet 114*a* (see FIG. 17). A hollow table 124 is adapted to be removably fitted to the space below the opening 123*a*, on which a vessel such as a glass can be loaded whenever the ice pieces 121 are to be delivered. This table 124 has on the upper surface thereof a multiplicity of slits 124*a* for draining the water drops dripping from the outlet 114*a* and opening 123*a* to collect them therein so as to prevent splitting of the water drops around the machine. The front panel 123 also has a power supply indication lamp L and a push button 125 for the sixth switch $SW_6$ for discharging the ice pieces 121 stored in the ice chamber 183 provided on the upper part thereof extending above the opening 123*a*, and the ice discharging unit 113 is designed to be operated to discharge the ice pieces 121 stored in the ice chamber 183 through the outlet 114*a* and the opening 123*a*, only while the push button 125** is depressed to turn on the sixth switch $SW_6$.

An opening (not shown) is defined on the bottom of the rectangular housing 110 to communicate to the machine chamber 112. The opening is designed to be removably covered by a filter 126. The filter 126 functions to collect dusts in the outer air to be introduced to the machine chamber 112 for cooling the condenser 111 thereby to prevent reduction in the cooling capacity thereof to be caused by the clogging of the condenser. Incidentally, tile filter 126 is also designed to be easily drawn out from the front side of the rectangular housing 110.

(Inner cover)

As shown in FIG. 17, an inner cover 127 is removably applied to the front side of the ice bin 114, on which the actuator motor AM for tilting the water tray 116 in the freezing unit 115, the rocking motor RM for rocking a rocking plate 154 (to be described later) and a discharging motor GM for the ice discharging unit 113 are all mounted at the front surface thereof. Accordingly, the respective motors AM, RM, GM and members incidental thereto can all be exposed by removing the front panel 123, whereby maintenance and repair thereof can be facilitated. Meanwhile, the inner cover 127 having already mounted thereon the motors AM, RM, GM can be fitted on the front side of the ice bin 114, leading to reduction in the time required for the assembly of the automatic ice making machine, advantageously.

(Freezing unit)

Figure 18:
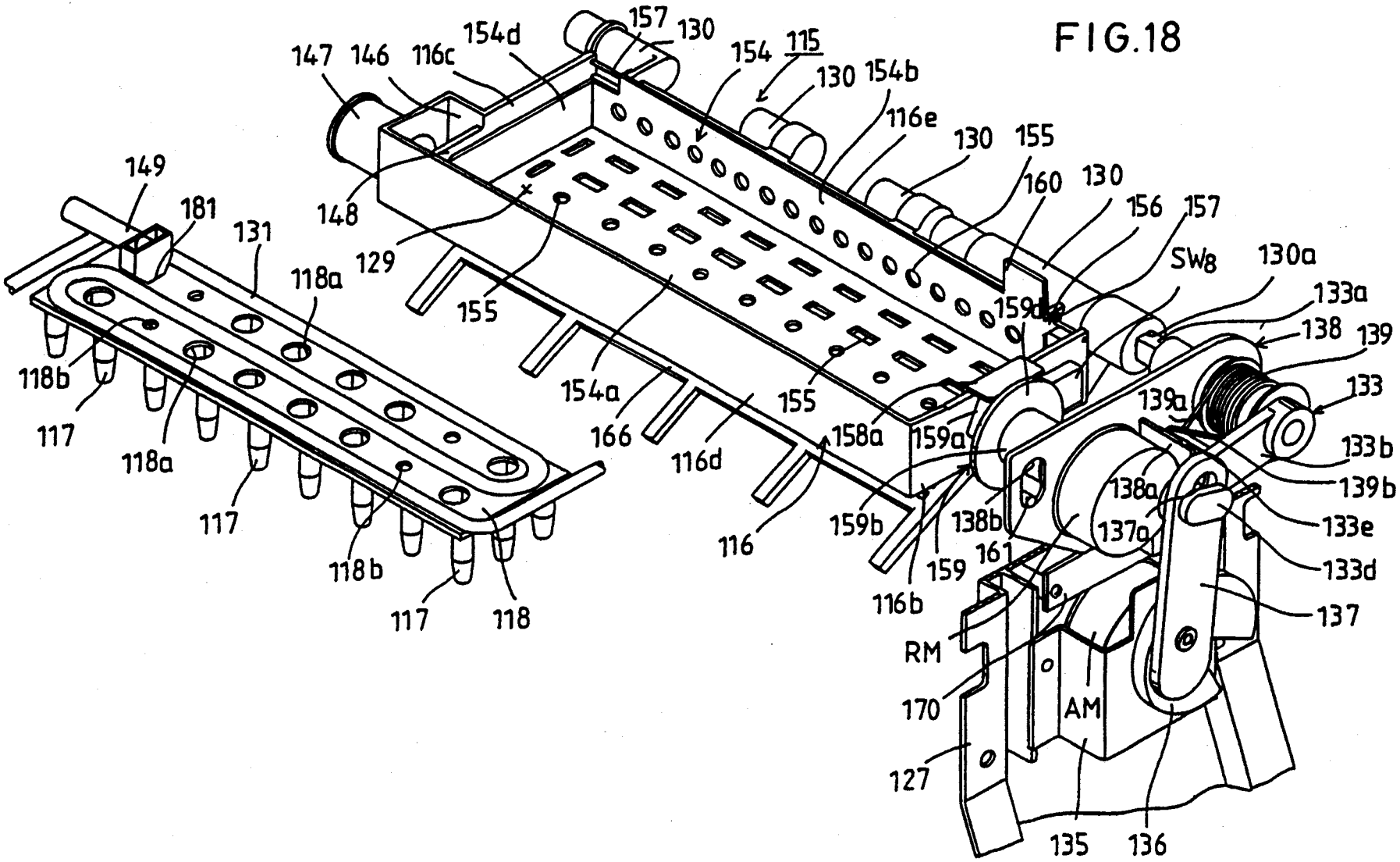
FIG. 18 shows in partially exploded perspective view the freezing unit.
Figure 19:
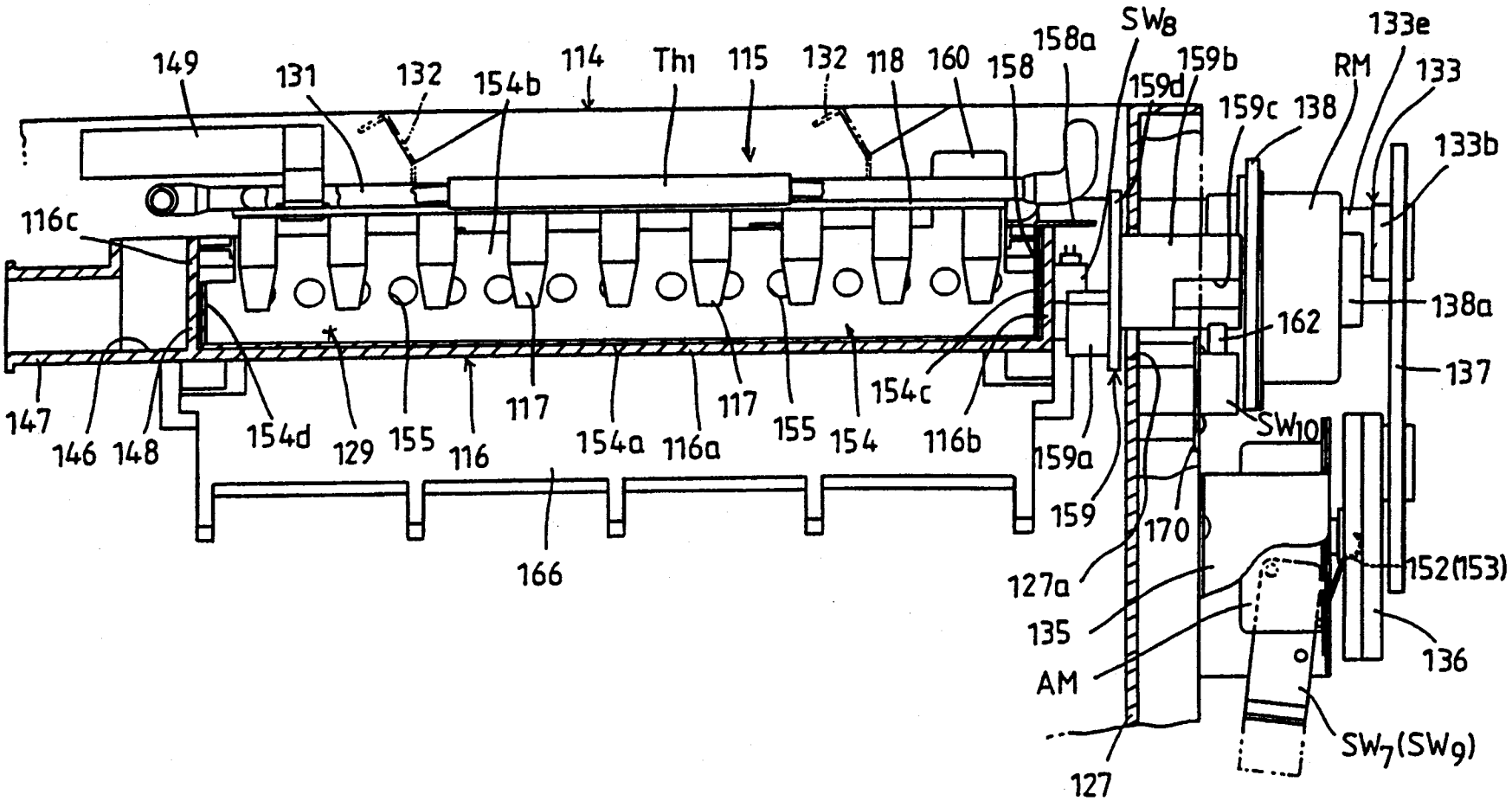
FIG. 19 shows in vertical section the major portion of the freezing unit.
Figure 21:
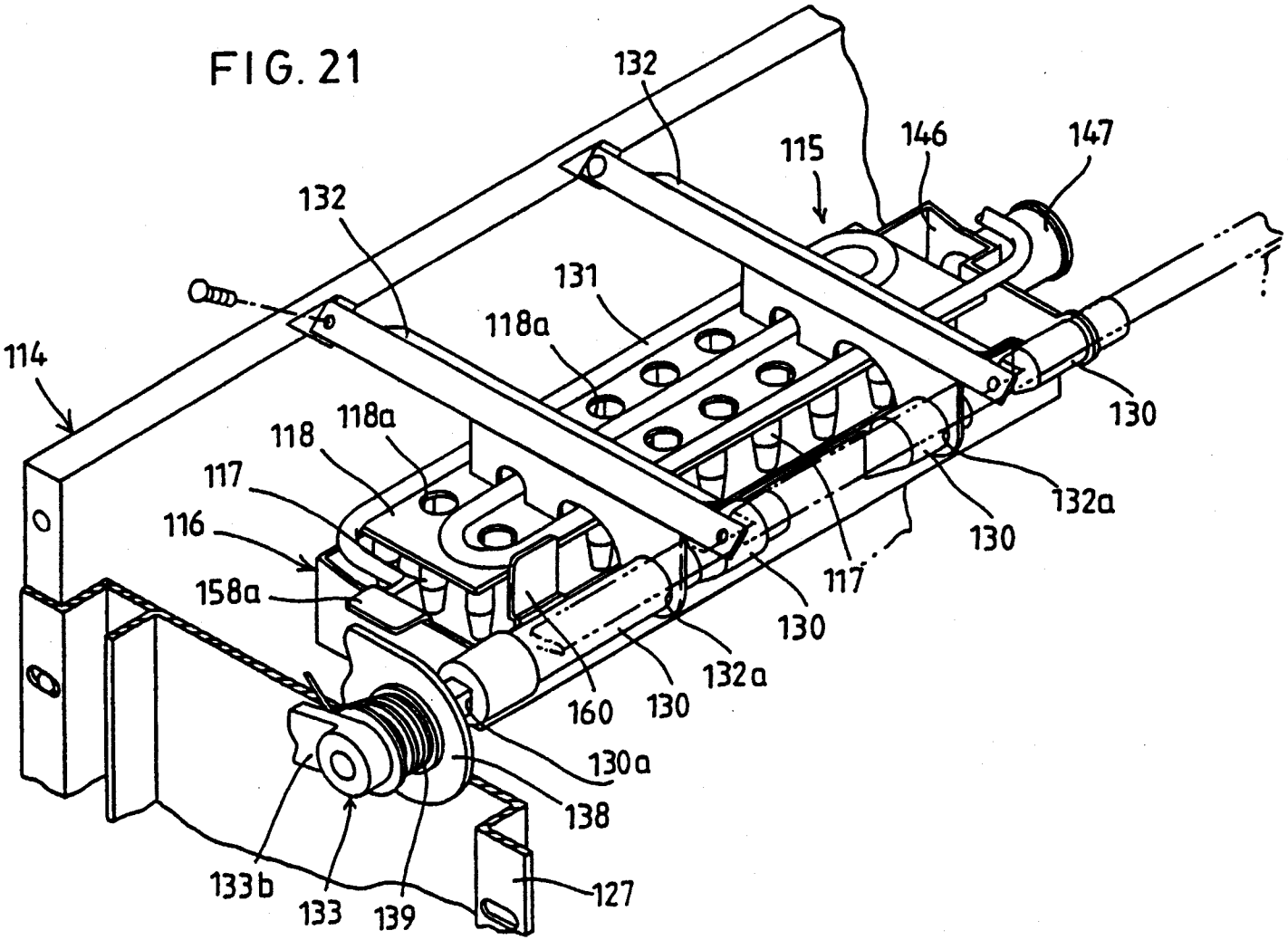
FIG. 21 shows schematically in perspective view the freezing unit disposed in a box-like chamber.

FIG. 19 shows minutely a vertical sectional view of the freezing unit 115, and the water tray 116, the structure of which is as shown in FIG. 18, is designed to carry a predetermined level of water to be frozen in the freezing chamber 129 defined therein. In other words, the freezing chamber 129 is defined by a rectangular bottom **116*a* of the water tray 116 and four walls 116*b*, 116*c*, 116*d*, 116*e* standing upright from the respective sides of the rectangular bottom 116*a*. A plurality of pintles 130, are integrally formed and aligned horizontally on the outer surface of the right wall 116*e* in FIG. 18. These pintles 130 are pivotally fitted in the through holes 132*a* defined in the brackets 132 holding the freezing base plate 118 at an upper position in the ice bin 114, so that the water tray 116 can be pivoted sideways on the pintles 130 (see FIG. 21). Incidentally, a water supply pipe 149 for supplying water to be frozen is removably disposed to the freezing base plate 118 at an appropriate position (to be described later), which is de signed to supply a predetermined amount of water to be frozen to the freezing chamber 129 by opening the water valve WV in accordance with the timing to be described later (see FIG. 40**).

Meanwhile, a square hole **130*a* is defined in the foremost pintle 130, in which a square shaft 133*a* protruding from the free end of a pivotal shaft 133 (to be described later) is fitted. The pivotal shaft 133 is pivotally supported on the inner cover 127**, and thus the water tray 116 is designed to be tilted downward and reset upward on the pintles 130 with the rotation of the actuator motor AM mounted on the inner cover 27, as shown in FIGS. 32 to 35. Such constitution of the water tray 116, which is designed to be tilted sideways, can reduce width of the ice making machine.

(Water tray tilting mechanism)

Figure 16:
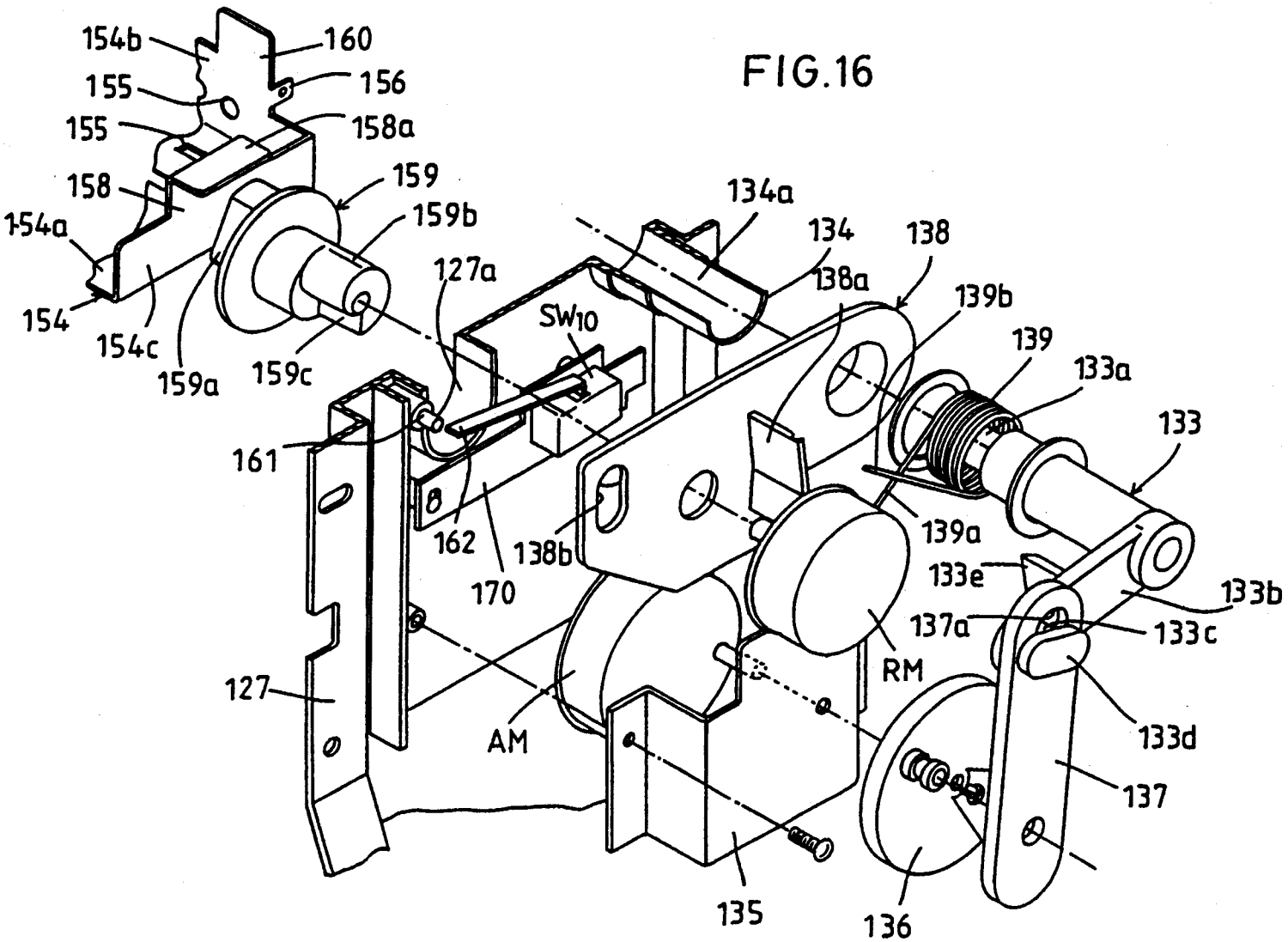
FIG. 16 shows in perspective view the major portion of the detection mechanism according to a second embodiment of the invention.

A cylindrical bearing 134 protruding forward is provided on the inner cover 127 at a position corresponding to the location of the pintles 130 of the water tray 116, and the pivotal shaft 133 is pivotally supported in the through hole 134*a* defined in the bearing 134. The square shaft 133*a* formed on the other end of the pivotal shaft 133 is fitted in the square hole 130*a* of the pintle 130. A lever 133*b* is formed integrally with the pivotal shaft 133 to extend radially from the front end portion thereof, and a protrusion 133*c* is formed on the front surface of the lever 133*b* at the free end portion thereof. As shown in FIGS. 16 and 18, a cam plate 136, which is a disc having a predetermined diameter and a notch on the circumference thereof, is disposed to the rotary shaft of the actuator motor AM, mounted to the inner cover 127 through a bracket 135, protruding forward through the bracket 35. A connection rod 137 is pivotally supported eccentrically at one end portion thereof onto the front surface of the cam plate 136, and the other end portion of the connection rod 137 has a slot 137*a* in which the protrusion 133*c* of the lever 133*b* formed integrally with the pivotal shaft 133 is slidably engaged. Accordingly, the pivotal shaft 133 can be pivoted reciprocatingly within a predetermined range of angle through the cam plate 136 and the connection rod 137 by rotating the actuator motor AM, whereby to tilt the water tray 116.

Incidentally, an elliptic regulating piece 133*d* which can be inserted through the slot 137*a* of the connection rod 137 is disposed to the front end of the protrusion 133*c*, and this regulating piece 133*d* is elongated in the radial direction of the protrusion 133*c*, so that the connection rod 137 may not easily be disengaged from the protrusion 133*c* under engagement of the protrusion 133*c* with the slot 137*a*. Meanwhile, the lever 133*b* is designed to be shiftable within the allowance of the slot 137*a* relative to the connection rod 137 so as to tolerate any errors in the positions of the lever 133*b* and the connection rod 137 when the water tray 116 is stopped in the tilted posture. Further, an engagement piece 133*e* is formed on the rear side of the lever 133*b*, with which one end of a torsion spring 139 (to be described later) is designed to urge a fixture 138 (to be described later), on which the rocking motor (RM) is mounted, in a predetermined direction.

(Water discharging mechanism of water tray)

Figure 24:
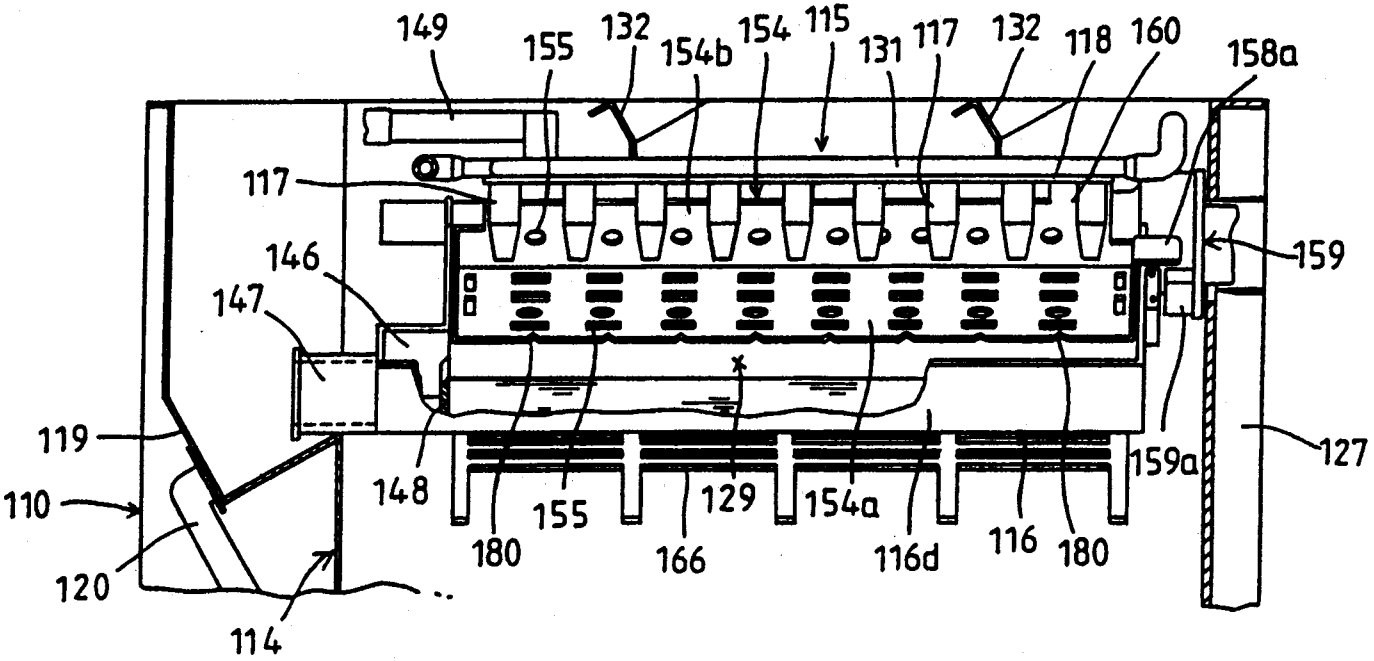
FIG. 24 shows in partially cut-away side view the freezing unit, where the water tray is tilted.

As shown in FIGS. 19 and 24, the water tray 116 has a drainage for discharging the water remaining in the freezing chamber 129 whenever the water tray 116 is tilted. More specifically, an auxiliary chamber 146 is defined backward on the rear wall 116*c* of the water tray 116 at that end portion which can assume the lowest position when the water tray 116 is tilted, and a duct 147 having a predetermined length is connected to the outer (rear) wall surface of the auxiliary chamber 146. The water collecting section 119 for discharging the thus collected water to the outside of the machine defined at the rear side of the ice bin 114 locates below the duct 147. The auxiliary chamber 146 and the freezing chamber 129 are demarcated with a dam plate 148 which is lower than the wall 116*c*. Accordingly, the water to be frozen supplied to the water tray 116 is adapted to flow over the upper end of the dam plate 148 and to be discharged to the water collecting section 119 through the duct 147. In other words, the water to be frozen to be carried in the freezing chamber 129 can be maintained to a predetermined level by this dam plate 148. Upon switching to an ice releasing operation, the water tray 116 is tilted downward to discharge the water remaining therein through the duct 147, as shown in FIG. 24. With the water tray 116 stopping in this tilted posture, a part of the water to be frozen still remains therein due to the presence of the dam plate 148 (see FIG. 33) and combined with the water supplied afresh from the water supply pipe 149 for the next cycle of freezing operation to accelerate cooling of the water to be frozen.

Incidentally, the duct 147 also serves as a stopper for the water tray 116, which is abutted against the upper edge defining the water collecting section 119 and the ice bin, when the water tray 116 is tilted downward. Since the protrusion 133*c* of the pivotal shaft 133 is designed to be shiftable in the slot 137*a* of the connection rod 137 in the tilting mechanism, any possible load to be applied to the tilting mechanism to be caused by the displacement between the stopping position of the tilted water tray 116 and the stopping position of the actuator motor AM can be obviated.

Figure 30:
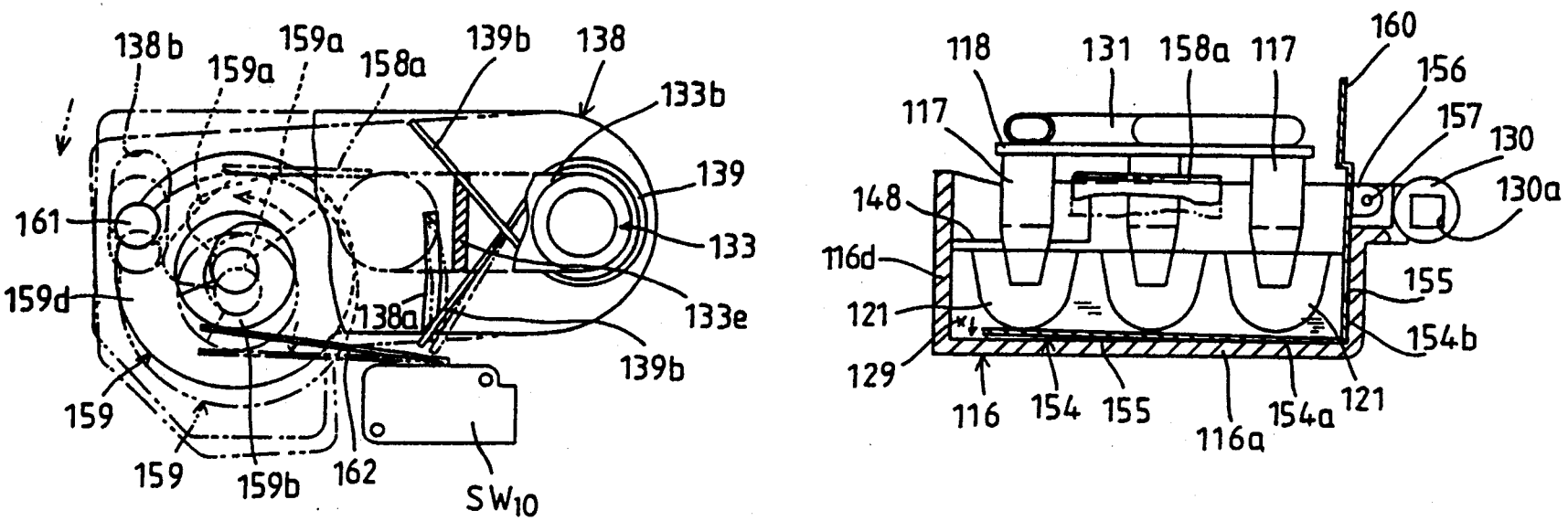
FIG. 30 shows an explanatory view of the freezing unit after completion of the freezing operation in the ice making machine and the rocking mechanism assuming a corresponding posture.
Figure 31:
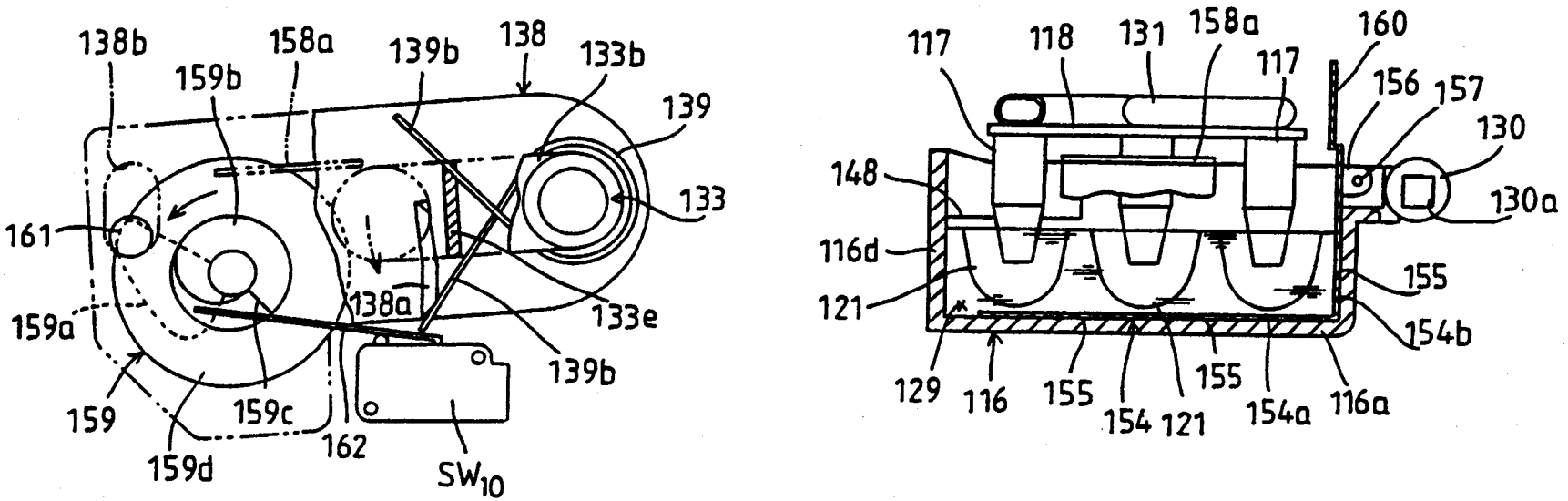
FIG. 31 shows an explanatory view of the freezing unit after completion of the freezing operation in the ice making machine and the rocking mechanism assuming a corresponding posture, where the rocking projection of the rocking member is retracted from the tilting orbit of the engagement piece of the rocking plate.
Figure 32:
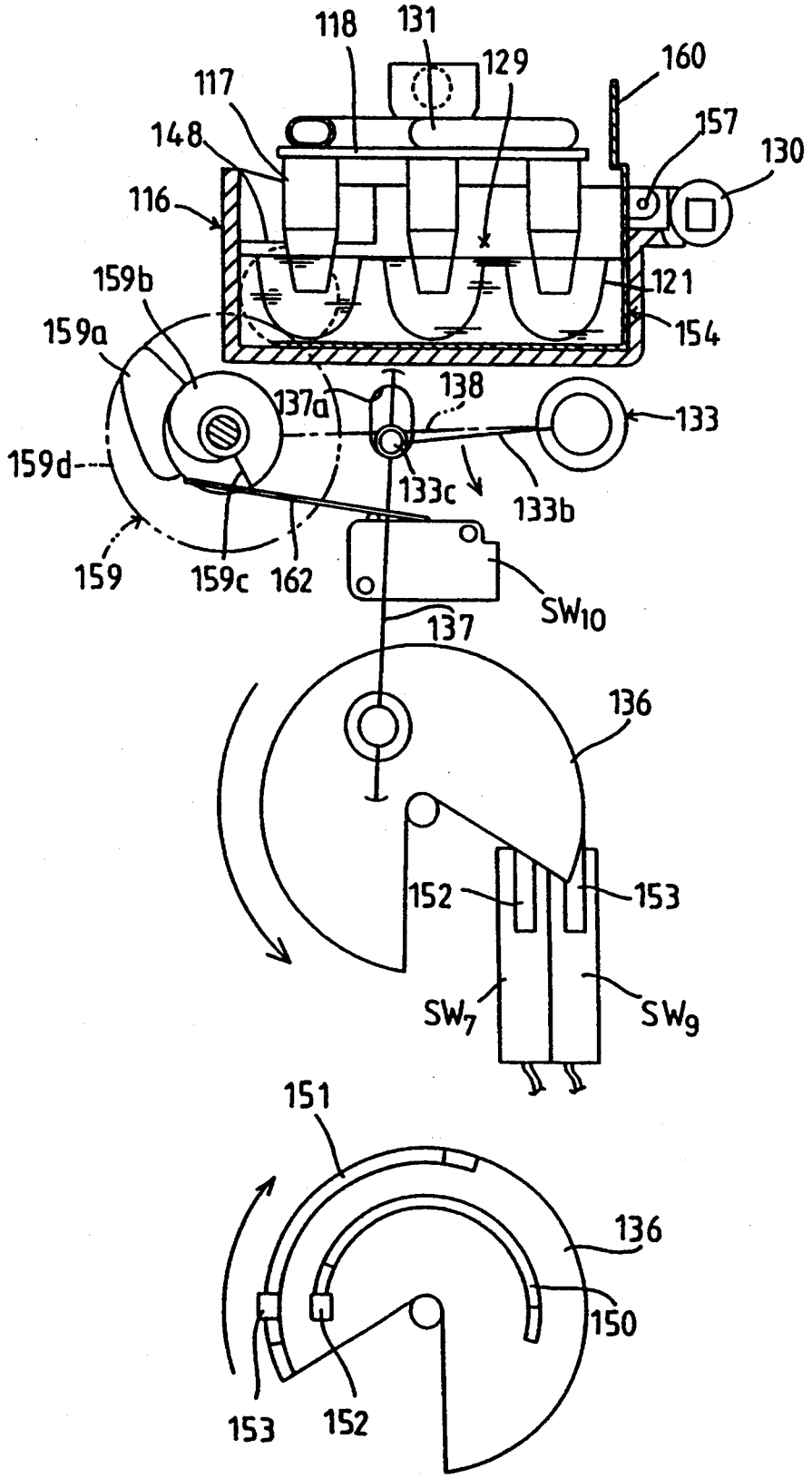
FIG. 32 shows an explanatory view of the freezing unit after completion of the freezing operation in the ice making machine, and the rocking mechanism and tilting mechanism assuming corresponding postures respectively.

The freezing base plate 118 is maintained horizontally at an upper position of the ice bin 114 through a plurality of brackets 132, and an evaporator 131 led out of the freezing system housed in the machine chamber 112 is disposed zigzag on the upper surface of the freezing base plate 118. Meanwhile, a plurality of freezing fingers 117 protrude downward from the lower surface of the freezing base plate 118, and these freezing fingers 117 are adapted to be dipped in the water to be frozen carried in the water tray 116 during the freezing operation. As heat exchange with the cooling medium in the evaporator 131 is proceeded by operating the freezing system, the freezing fingers 117 are cooled and maintained at a temperature of 0° C. or lower to allow ice pieces 121 to grow gradually around the freezing fingers 117, as shown in FIG. 30. Incidentally, the freezing fingers 117 are formed at the positions corresponding to the location of the evaporator 131 so that they can be cooled effectively.

The freezing base plate 118 has a plurality of through holes 118*a* are formed at predetermined intervals at the positions spaced from the location of the evaporator 131 (freezing fingers 117), as shown in FIG. 18, so as to reduce the surface area of the freezing base plate 118 and prevent escape of the low temperature at the positions other than the freezing fingers 117, whereby to improve cooling efficiency of the freezing fingers 117 and enable formation of ice pieces in a short time. Meanwhile the dew drops formed during the freezing operation or ice releasing operation do not stay on the upper surface of the freezing base plate 118 but drop through the through holes 118*a*, whereby reduction in the cooling efficiency due to the growth of unnecessary ice or possible troubles in the tilting of the water tray 116 or the rocking of the rocking plate 154 can be prevented. Further, not only the weight of the freezing base plate 118 can be reduced, but also the time required for releasing the ice pieces 121 in the ire releasing operation can be reduced by virtue of the improved heat exchange efficiency.

Tapped holes 118b are defined at appropriate positions of the freezing base plate 118, so that the freezing base plate 118 can be secured to the ice bin 114 through brackets 132 by fitting screws (not shown) therethrough. Further, a fitting member 181 is formed on the base plate 118 for fitting the water supply pipe 149, through which the water supply pipe 149 can removably be fitted.

(Cam control mechanism)

Figure 20:
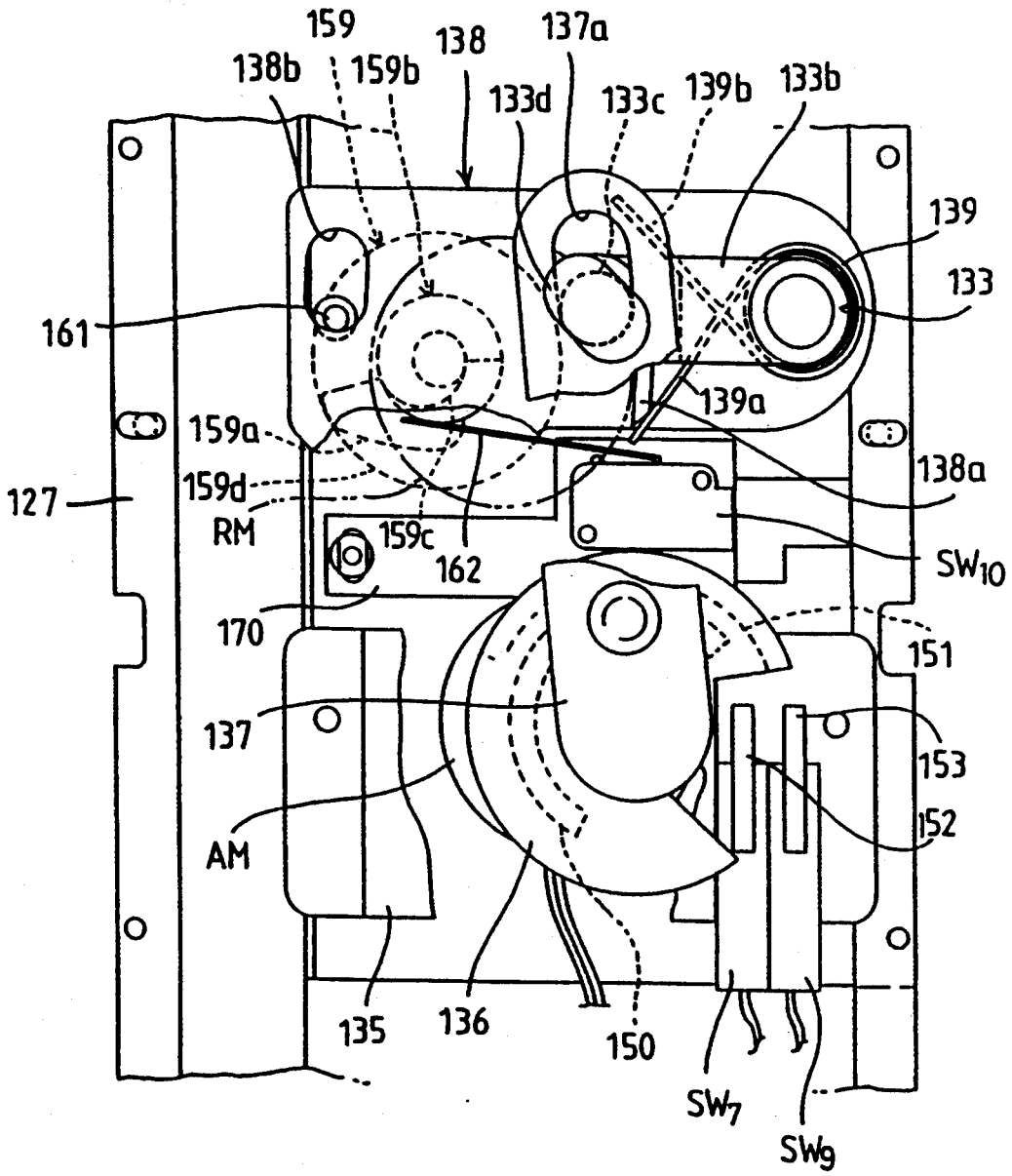
FIG. 20 shows in partially cut-away front elevation a water tray tilting mechanism and a rocking plate rocking mechanism.

As shown in FIG. 20, a first cam 150 and a second cam 151 are formed on the rear surface of the cam plate 136 disposed to the actuator motor AM at radially staggered positions. Meanwhile, a seventh switch $SW_7$ and a ninth switch $SW_9$ are disposed to the bracket 135 at the positions corresponding to the locations of the first cam 150 and the second cam 151. By the cam actions to be added in accordance with predetermined timings to the rotation of the actuator motor AM, the following motions to be caused by the operation of the actuator motor AM are designed to be controlled:

(1) tilting or resetting of the water try 116 and stopping it at such postures, as well as, opening of the hot gas valve HV; and (2) opening and closing of the water valve WV for supplying water to be frozen. More specifically, the first cam 150 and the second cam 151 each assume a form of arcuate ridge having a predetermined radius and protruding in the axial direction, and a lever 152 extending from the seventh switch $SW_7$ is designed to be abutted against the first cam 150 or spaced therefrom with a predetermined timing. The seventh switch $SW_7$ is turned on, upon contact of the lever 152 of the seventh switch $SW_7$ with the first cam 150. The seventh switch $SW_7$ is connected to a relay $X_2$ and the actuator motor AM, as shown in the control circuit diagram of FIG. 28, and controls tilting and resetting of the water tray 116 as well as stopping thereof at such postures by the actuator motor AM and also opening of the hot gas valve HV, as will be described later. Incidentally, the timing of actuating the seventh switch $SW_7$ by the first cam 150 is shown in the timing chart of FIG. 40.

Figure 28:
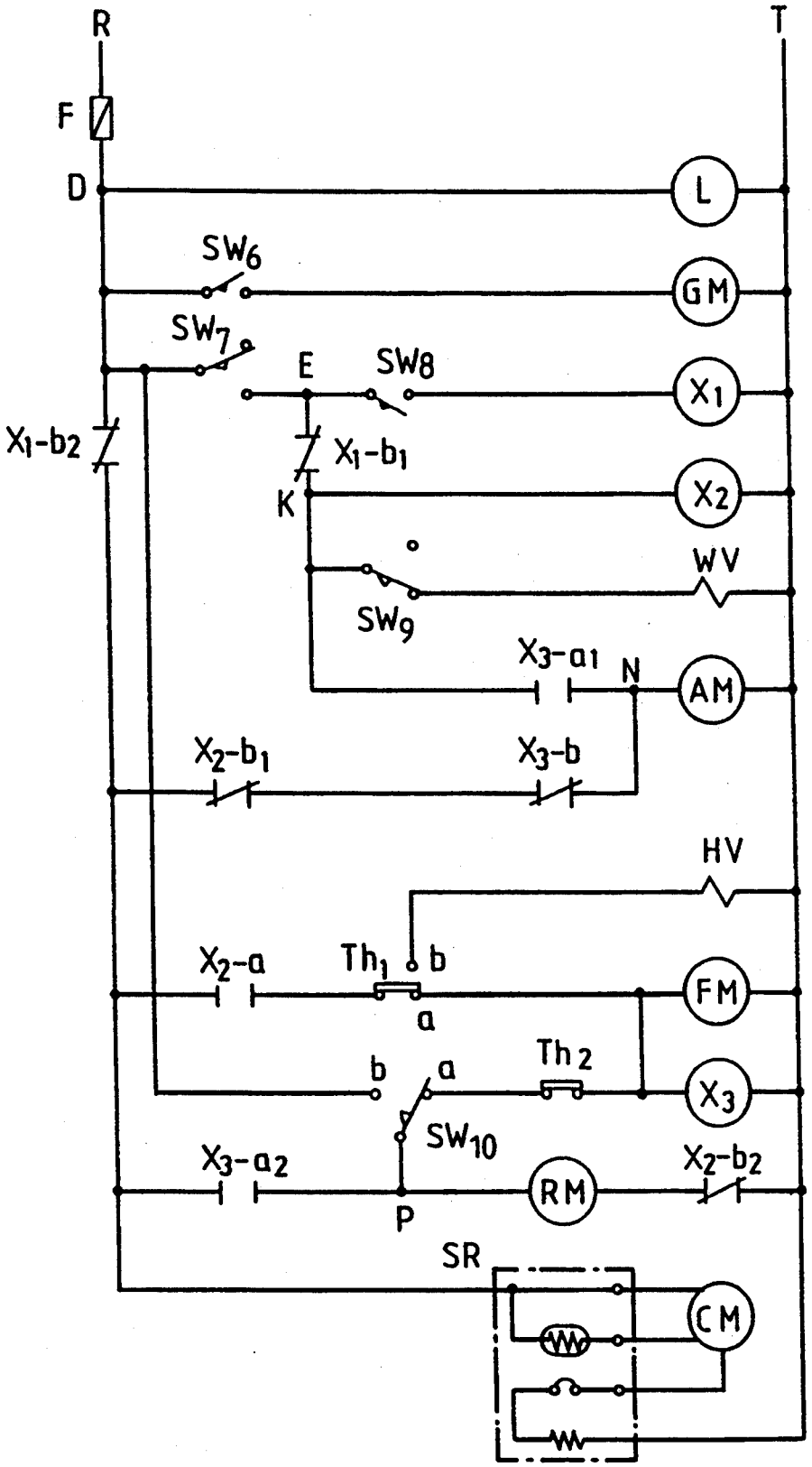
FIG. 28 shows a control circuit diagram of the ice making machine.

Meanwhile, the lever 153 extending from the ninth switch $SW_9$ is designed to be brought into contact with the second cam 151 and to be spaced therefrom in accordance with a predetermined timing. The ninth switch $SW_9$ is designed to be turned on upon contact of the lever 153 thereof with the second cam 151. As shown in FIG. 28, the ninth switch $SW_9$ is connected to the water valve WV to control opening thereof (as will be described later). The timing of the cam actions to be effected by the second cam 151 and the ninth switch $SW_9$ is as shown in the timing chart of FIG. 40.

(Rocking plate and rocking mechanism)

A rocking plate 154 is disposed in the freezing chamber 129 defined in the water tray 116 in such a way that it can be rocked freely therein. The rocking plate 154 has a rectangular bottom plate 154a and side walls 154b, 154c, 154d standing upright from the three side edges of the bottom plate 154a, except for the side edge opposing to the left wall 116d, which is to assume the lowest position when the water tray 116 is tilted and is designed to be rocked by the rotation of the rocking motor RM. The circumferential size of the rocking plate 154 is designed to be slightly smaller than the inner circumferential size of the bottom 116a of the freezing chamber 129, and a pair of outward protrusions 156 formed on each longitudinal side of the side wall 154b are pivotally supported on the water tray 116 by a pair of pins 157. With the rocking plate 154 being pivotally supported in the water tray 116, the rocking plate 154 is brought into intimate contact with the bottom of the freezing chamber 129, as shown in FIG. 19.

Figure 25:
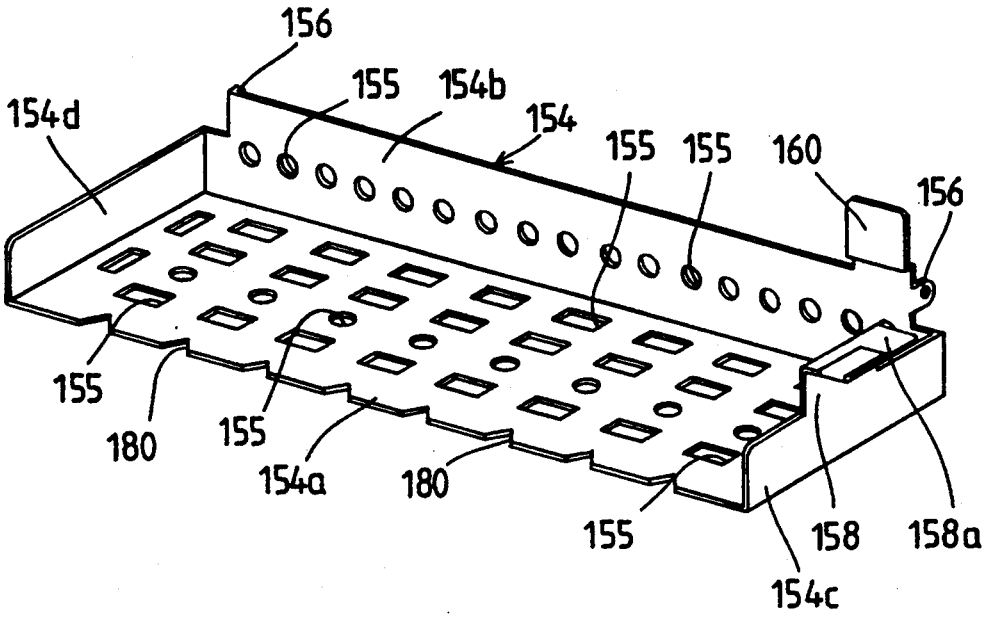
FIG. 25 shows schematically in perspective view the rocking plate.

A multiplicity of circular and square through holes 155 are defined at predetermined intervals on the bottom plate 154a of the rocking plate 154, as shown in FIG. 25. These through holes 155 are designed to locate between every two adjacent freezing fingers 117 so as to accelerate agitation of the water to be frozen at such positions and prevent effectively opacification of the ice pieces 121 (see FIG. 39). Meanwhile, through holes 155 are also formed on the longitudinal side wall 154b at predetermined intervals adjacent to the surface of the water to be frozen carried in the water tray 116, and these through holes 155 also functions to accelerate agitation of the water to be frozen. The side walls 154c, 154d formed on the shorter edges of the bottom plate 154a function to agitate vigorously the water to be frozen staying adjacent to the walls 116b, 116c of the water tray 116, when the rocking plate 151 is rocked.

The side wall 154b of the rocking plate 154 has a vertical member 160 extending upward from the upper edge thereof. By allowing the vertical member 160 to engage with the freezing base plate 118 on the way that the rocking plate 154 is tilted together with the water tray 116, the rocking plate 154 can be separated from the water tray 116 and can assume a fixed tilted posture as such (see FIG. 33).

The circumferential size of the rocking plate 154 is designed to be slightly smaller than the inner circumferential size of the bottom 116a of the freezing chamber 129 so that it can be rocked smoothly within the freezing chamber and that the water to be frozen can effectively be agitated thereby. Accordingly, when the water tray 116 is tilted further relative to the rocking plate 154 stopping by the engagement of the vertical member 160 with the freezing base plate 118 in the freezing operation, the clearance defined between the free end portion having no side wall and the wall 116d is designed to be small. In such constitution, if the edge of the free end portion of the bottom plate 154a is straight, it may happen that the water remaining in the water tray 116 swell upward beyond the bottom plate 154a by the surface tension to flow out over the upper end of the wall 116d to the outside due to the small clearance between the wall 116d and the free end of the bottom plate 154a. Therefore, V-shaped notches 180 are formed at predetermined intervals along the free end of the base plate 154a in the rocking plate 154 according to the second embodiment, as shown in FIG. 25. Namely, by securing greater clearances between the free end of the bottom plate 154a and the wall 116d at the notched portions, the water staying therebetween can flow down into the water tray 116 through the notches 180, preventing flow out of the water over the upper end of the wall 116d.

Figure 26:
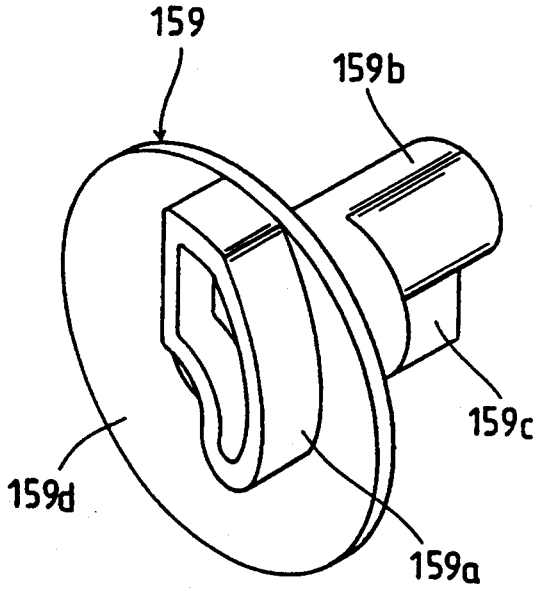
FIG. 26 shows perspectively a rocking member as viewed from the rocking protrusion side.
Figure 27:
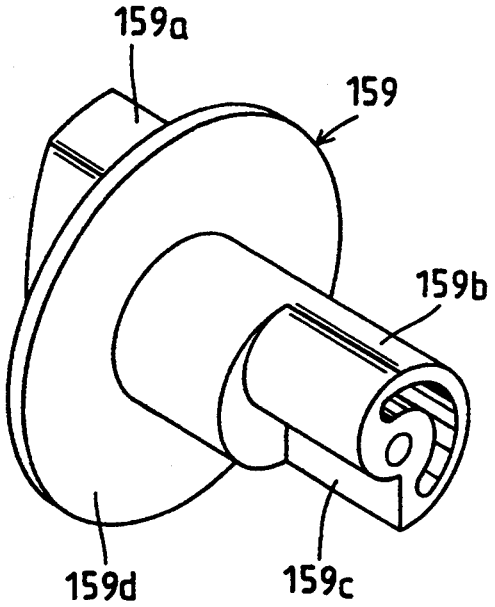
FIG. 27 shows perspectively the rocking member as viewed from the cam side.
Figure 29:
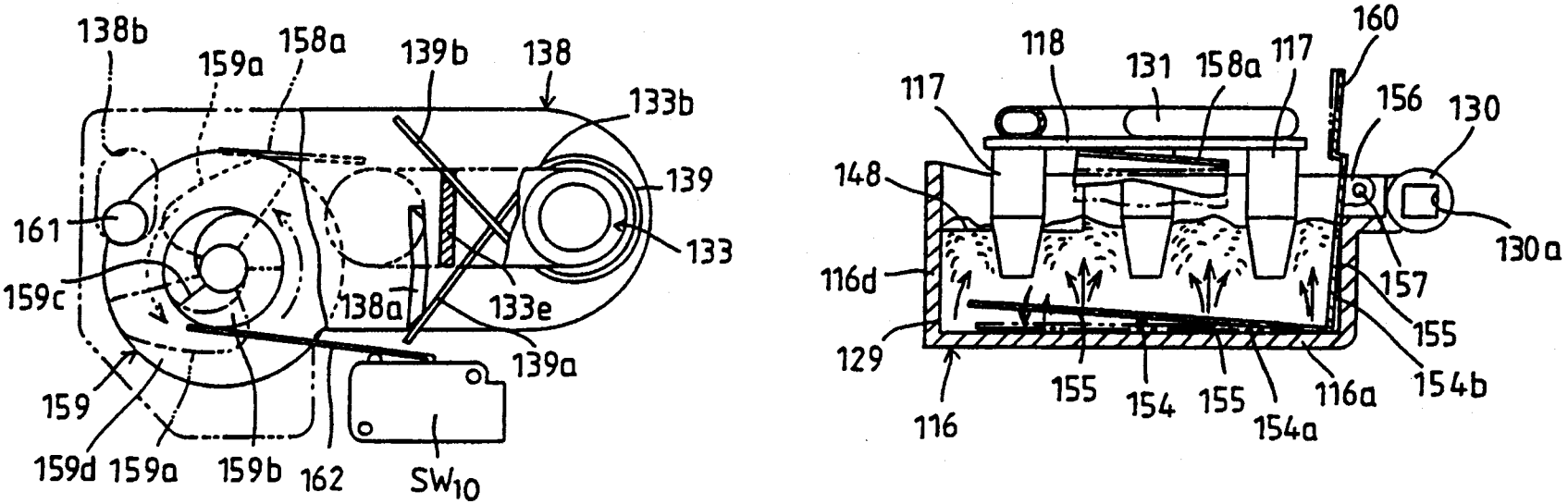
FIG. 29 shows an explanatory view of the freezing unit under rocking of the rocking plate during the freezing operation in the ice making machine and the rocking mechanism assuming a corresponding posture.
Figure 37:
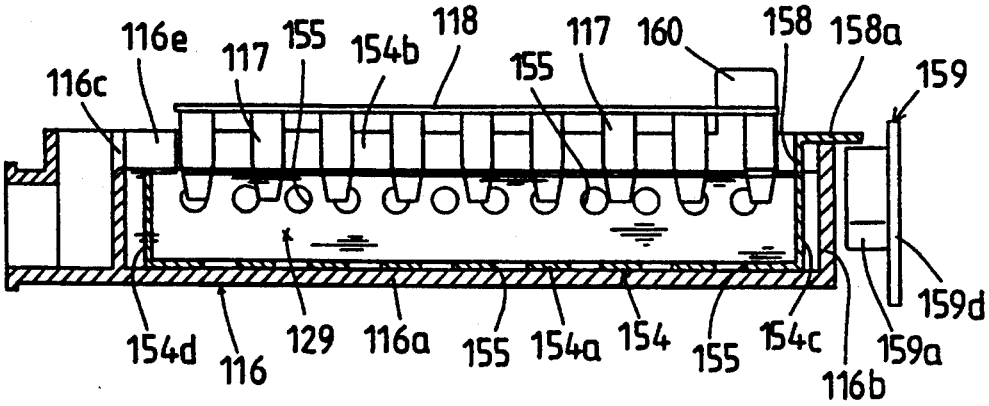
FIG. 37 shows in vertical section the major portion of the freezing unit, where the rocking protrusion is going to be engaged with the engagement piece of the rocking plate.
Figure 38:
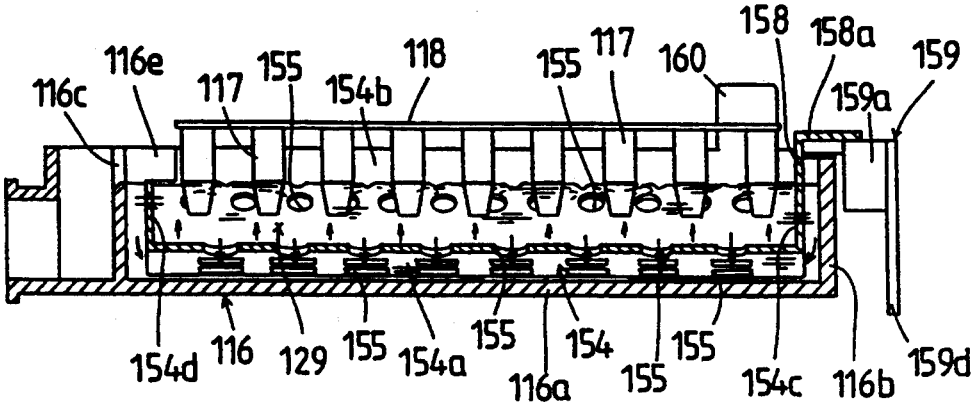
FIG. 38 shows in vertical section the major portion of the freezing unit, where the rocking protrusion is engaged with the engagement piece of the rocking plate to ascend the rocking plate.

As shown in FIG. 16, an inverted L-shaped engagement piece 158 is integrally formed with the front side wall 154c of the rocking plate 154, and the upper horizontal portion 158a thereof extends outward beyond the wall 116b of the freezing chamber 129. Meanwhile, a vertically elongated opening 127*a* is defined in the inner cover 127 at the position corresponding to the location of the upper horizontal portion 158*a*, in which a rocking member 159 rotated by the rocking motor RM is slidably fitted. As shown in FIGS. 26 and 27, the rocking member 159 basically consists of a disc-shaped main body 159*d*, a rocking protrusion 159*a* formed eccentrically on the surface thereof opposing to the rear side of the inner cover 127 (opposing to the water tray 116) and a cylindrical cam 159*b* formed coaxially on the other side of the disc-shaped main body 159*d*, and the rocking motor RM is connected to the axial end of the cam 159*b*. In the rocking member 159, the rocking protrusion 159*a* is designed to be engageable with the lower surface of the upper horizontal portion 158*a* of the rocking plate 154, with the surface of the disc-shaped main body 159*d* having the cam 159*b* formed thereon being abutted against the rear surface of the inner cover 127. Accordingly, the rocking protrusion 159*a* is rotated under engagement with the upper horizontal portion 158*a*, as shown in FIG. 29, by rotating the rocking member 159 counterclockwise, to lift the rocking plate 154 to a predetermined height from the bottom of the freezing chamber 129, whereas upon disengagement of the rocking protrusion 159*a* from the upper horizontal surface 158*a*, to allow the rocking plate 154 to drop by its own weight onto the bottom of the freezing chamber 129. Namely, by rotating the rocking motor RM during the freezing operation, the rocking plate 154 repeats such rocking motion on the pins 157 in the freezing chamber 129, whereby the water to be frozen can constantly be agitated (see FIGS. 37 to 39). Incidentally, the water to be frozen in the freezing chamber 129 can vigorously be agitated thoroughly by the through holes 155 and the side walls 154*c*, 154*d* of the rocking plate 154.

(Fitting structure of rocking motor RM)

As shown in FIGS. 16 and 20, one end portion of the planar fixture 138 is pivotally fitted on the bearing 134 protruding from the inner cover 127, and the rocking motor RM is disposed onto the front surface of the fixture 138 at a position spaced from the pivotally fitted portion thereof. The rocking motor RM is connected to the cam 159*b* protruding forward from the rocking member 159 through the through hole 127*a*. Meanwhile, a vertical member 138*a* is formed on the front side of the fixture 138 at a position between the pivotally fitted portion thereof and the rocking motor RM, and one end portion 139*a* of the torsion spring 139 is engaged with the lower end of the vertical member 138*a*. The engagement piece 133*e* formed on the lever 133*b* locates adjacent to the vertical member 138*a*, and the other end portion 139*b* of the torsion spring 139 is engaged with the upper end of the engagement piece 133*e*. In the state where the water tray 116 is maintaining the horizontal posture, the upper end of the engagement piece 133*e* extends upward over the upper end of the vertical member 138*a* of the fixture 138, as shown in FIG. 29. Accordingly, in this state, the fixture 138 is constantly urged to turn clockwise on the bearing 134 under the resilient action of the torsion spring 139. Upon application of a predetermined external force to the rocking motor RM, the fixture 138 is designed to be pivoted by a predetermined angle on the bearing 134.

Namely, the torsion spring 139 functions to maintain the rocking protrusion 159*a* of the rocking member 159 at the operational position where it can be engaged with the engagement piece 158 of the rocking plate 154 while the water tray 116 is assuming a horizontal posture during the freezing operation. Meanwhile, when the water tray 116 is tilted upon switching from the freezing operation to the ice releasing operation, the upper end of the engagement piece 133*e* of the lever 133*b* is shifted to a position lower than the upper end of the vertical member 138*a* of the fixture 138, and the end portion 139*b* of the torsion spring 139 is engaged with the upper end of the vertical member 138*a* (see FIG. 36). Accordingly, the torsion spring 139 is adapted not to urge the fixture 138 while the water tray 116 is tilted.

Incidentally, a vertical slot 138*b* is defined in the fixture 138 at the distal end portion spaced from the pivotally supported portion thereof, and a regulating pin 161 provided on the inner cover 127 at the corresponding position is slidably fitted therein. The regulating pin 161 functions to regulate the pivoting range of the fixture 138 so that the lower extremity of the slot 138*b* may be normally abutted against the regulating pin 161 under the resilient action of the torsion spring 139 to allow the rocking member 159 to be in the operational position (see FIG. 29).

(Switch $SW_{10}$ for detecting completion of ice formation and switch $Th_1$ for detecting completion of ice releasing operation)

A tenth switch $SW_{10}$ such as a microswitch for detecting completion of ice formation is disposed on the inner cover 127 through a bracket 170 with the lever 162 of the switch $SW_{10}$ being on the descending orbit of the cam 159*b* of the rocking member 159 so as to be able to be abutted against the cam 159*b* as the fixture 138 (rocking motor RM) is pivoted and operate the switch $SW_{10}$. Namely, as will be described later referring to FIG. 30, when ice pieces 121 are formed around the freezing fingers 117 as the freezing operation proceeds, the rocking plate 154 is brought into contact with these ice pieces 121 in its upward stroke to exert a downward counterforce to the rocking motor RM through the engagement piece 158 and the rocking protrusion 159*a*. Accordingly, the fixture 138 having mounted thereon the rocking motor RM is pivoted counterclockwise on the bearing 134 and allows the cam 159*b* to depress the lever 162 of the tenth switch $SW_{10}$ in its pivoting process to change over the tenth switch $SW_{10}$ from the contact "a" to the contact "b", and thus completion of ice formation is detected. Incidentally, since the bracket 170 is disposed to the inner cover 127 to be adjustable in the vertical direction, the position of the lever 162 of the tenth switch $SW_{10}$ can be adjusted by adjusting vertically the position of the bracket 170. Thus, the size of the ice pieces 121 to be formed around the freezing fingers 117 can be changed.

It should be noted here that, if the rocking motor RM is stopped upon changing over of the tenth switch $SW_{10}$ to the contact "b", the rocking protrusion 159*a* abutted against the engagement piece 158 of the rocking plate 154 interferes with the tilting motion of the rocking plate 154. Therefore, in the second embodiment, a notch 159*c* is formed on the cam 159*b* of the rocking member 159, which can change over the tenth switch $SW_{10}$ to the contact "a" with the rocking motor RM being pivoted downward whereby to control the rocking protrusion 159*a* to deviate from the tilting orbit of the engagement piece 158. Meanwhile, this notch 159*c* is defined on the cam 159*b* in a positional relationship such that it may locate at a position corresponding to that of the lever 162 of the tenth switch $SW_{10}$ when the rocking protrusion 159a is spaced from the upper horizontal portion 158a of the engagement piece 158. In other words, the motor RM is designed:

(1) to be rotated still after changing over of the tenth switch $SW_{10}$ for detecting completion of ice formation to the contact "b" by the pivoting of the rocking motor RM; and (2) to be stopped when the notch 159c is brought to the position corresponding to the location of the lever 162 of the switch $SW_{10}$ to change over the switch $SW_{10}$ to the contact "a". Thus, the rocking protrusion 159a is deviated from the tilting orbit of the engagement piece 158 of the rocking plate 154 and thus does not interfere with the tilting motion of the rocking plate 154. By allowing the tenth switch $SW_{10}$ for detecting completion of ice formation to serve also as the switch for positioning the rocking protrusion 159a of the rocking member, the number of the parts in the ice making machine can be reduced to reduce cost thereof.

As shown in FIG. 19, a thermometal switch $Th_1$ for detecting completion of the ice releasing operation is disposed on the upper surface of the freezing base plate 118 in the freezing unit 115. This thermometal switch $Th_1$ is designed to be changed over to the contact "b" upon dropping of the temperature of the freezing base plate 118 to a predetermined level by the freezing operation, or changed back from the contact "b" to the contact "a" upon detection of the sudden temperature rise caused by dropping of the ice pieces 121 from the freezing fingers 117 by the ice releasing operation. Simultaneously, the hot gas valve HV is designed to be closed, as will be described later, and the actuator motor AM is also designed to be rotated.

(Ice discharging unit and ice fullness detection switch)

An ice discharging motor GM is disposed at the front lower position of the inner cover 127, and a screw 163 for carrying the ice pieces to be driven by the motor GM is disposed in the ice chamber 183 to extend therein. The inner end portion of the screw 163 is rotatably fitted in a recess 164 defined at the corresponding position of the ice bin 114, as shown in FIG. 17, so that the screw 163 can be rotated at a fixed position. The the ice discharging motor GM is designed to be rotated only while the push button 125 provided on the front panel 123 is depressed to actuate the sixth switch $SW_6$ and carry the ice pieces 121 stored in the ice chamber 183 with the aid of the screw 163 to the outlet 114a.

As shown in FIG. 17, a regulating plate 165 is pivotally hanging from the rear side of the inner cover 127 at the position corresponding to the location of the screw 163 and inner than the position of the outlet 114a. This regulating plate 165 is designed to be pushed forward by the ice pieces 121 carried by the screw 163 to open the outlet 114a and allow delivery of the ice pieces 121 to the outside of the machine, as well as, to return to the initial position when the ice discharging unit 113 is stopped to close the outlet 114a and prevent the outer air from flowing into the ice chamber 183. Meanwhile, a separator 168 is disposed to the inner cover 127 at a position adjacent to the regulating plate 165, which functions to prevent the ice pieces 121 stored in the ice bin 114 from slipping out of the outlet 114a, as well as, to return some of the ice pieces carried by the screw 163 into the ice chamber 183 and prevent clogging of the outlet 114a thereby. Incidentally, a drain pipe 169 is provided at the bottom of the ice bin 114 adjacent to the recess 164, so that the water melting from the ice pieces 121 can be discharged to the outside of the ice bin 114.

Figure 22:
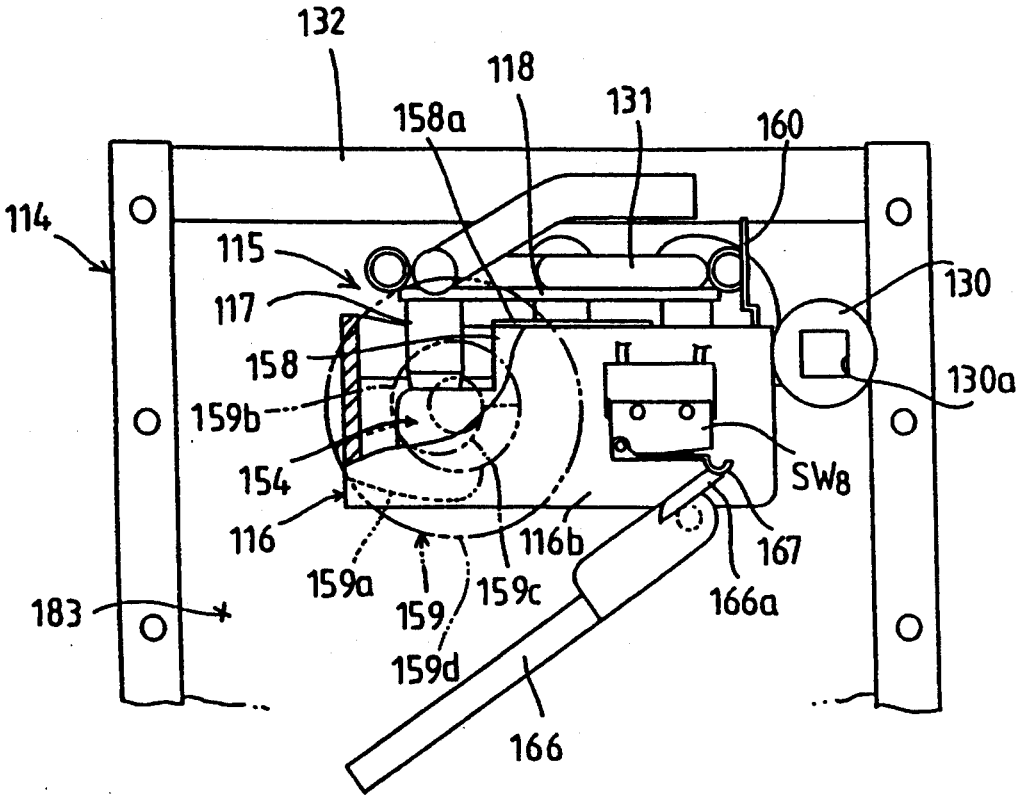
FIG. 22 shows in partially cut-away front elevation the freezing unit.

A detection plate 166 is pivotally supported on the lower surface of the water tray 116, which is normally maintained in such a state that the open end side thereof may be spaced apart downward from the bottom of the water tray 116, as shown in FIG. 22. An eighth switch $SW_8$ for detecting ice fullness is disposed to the front surface of the water tray 116 with its lever 167 being normally urged by the protrusion 166a formed on the front side of the proximal end portion of the detection plate 166. When the detection plate 166 is abutted against the ice pieces 121 in the process of tilting of the water tray 116 to turn clockwise relative to the water tray 116, the protrusion 166a is designed to be spaced from the lever 167 to turn on the switch $SW_8$, and thus ice fullness is detected. Incidentally, the protrusion 166a of the detection plate 166 is adapted to be abutted against the lever 167 of the eighth switch $SW_8$ under detection of no ice piece 121, so that the ice making machine can be stopped whenever the detection plate 166 happens to drop from the water tray 116 for some reason. Accordingly, no ice piece 121 is adapted to be formed under the condition where ice fullness is not detectable. Meanwhile, the free end portion of the detection plate 166 has a comb-like form, whereby the load to be applied to the detection plate 166 when it is abutted against the ice pieces 121 can be reduced.

(Example of electric control circuit)

FIG. 28 shows an electric control circuit in the ice making machine according to the second embodiment, in which a fuse F is interposed between a power supply line R and a joint D, and a power supply indication lamp L is interposed between the joint D and a line T. Likewise, (1) the sixth switch $SW_6$ for ice discharging and the ice discharging motor GM; (2) the seventh switch $SW_7$ for the actuator motor AM, the eighth switch $SW_8$ for detecting ice fullness and a relay $X_1$ are interposed in series respectively between the joint D and the line T. Meanwhile, a normally closed contact $X_1$-$b_1$ for the relay $X_1$ is interposed between a joint E and a joint K locating between the seventh switch $SW_7$ and the eighth switch $SW_8$. Between the joint K and the line T are interposed in series respectively (1) a relay $X_2$; (2) the ninth switch $SW_9$ for supplying water to be frozen and the water valve WV; and (3) a normally open contact $X_3$-$a_1$ for a relay $X_3$ and the actuator motor AM.

Meanwhile, a normally closed contact $X_2$-$b_1$ for the relay $X_2$ and a normally closed contact $X_3$-b for the relay $X_3$ are interposed in series between the normally closed contact $X_1$-$b_2$ of the relay $X_1$ connected in series to the fuse F and a joint N locating between the normally open contact $X_3$-$a_1$ of the relay $X_3$ and the actuator motor AM. A fan motor FM for the condenser 111 is connected to the contact "a" of the thermometal switch Th1 for detecting completion of the ice releasing operation connected in series to the normally open contact $X_2$-a of the relay $X_2$, while the hot gas valve HV for supplying a hot gas is connected to the contact "b" thereof. Further, between the normally closed contact $X_1$-$b_2$ of the relay $X_1$ and the line T, are interposed in series respectively (1) a normally open contact $X_3$-$a_2$ for the relay $X_3$, the rocking motor RM and a normally closed contact $X_2$-$b_2$ for the relay $X_2$; and (2) a relay SR and the compressor CM. The tenth switch $SW_{10}$ for detecting completion of ice formation is connected to a joint P locating between the normally open contact $X_3$-$a_2$ of the relay $X_3$ and the rocking motor RM, and a protective thermometal cut-off $Th_2$ is connected to the contact "a" of the switch $SW_{10}$, while the contact "b" thereof is connected to the joint D. Incidentally, the fan motor FM and the relay $X_3$ are connected in parallel.

Next, the actions of the ice making machine employing the detection mechanism according to the second embodiment of the invention will be described referring to the timing chart shown in FIG. 40.

(Initial operation)

Upon actuation of a power switch (not shown) of the ice making machine, the power supply indication lamp L is lit, and the compressor CM is also started to supply the cooling medium to the evaporator 131. Meanwhile, the actuator motor AM is rotated through the normally closed contacts $X_1$-$b_2$, $X_2$-$b_1$ and $X_3$-b of the relays $X_1$, $X_2$ and $X_3$, respectively, so that the water tray 116 assuming the horizontal posture starts tilting downward. The seventh switch $SW_7$ is turned on after the ninth switch $SW_9$ is turned off by the rotation of the motor AM, whereby the relay $X_2$ is actuated to close the normally open contact $X_2$-a which interlocks the rewith and actuate the relay $X_3$ through the thermometal switch $Th_1$. Thus, the actuator motor AM is allowed to continue its rotation through the normally open contact $X_3$-$a_1$ which interlocks with the relay $X_3$, in turn, to reset the water tray 116 to the horizontal posture without stopping in the tilted posture. Incidentally, the relay $X_3$ is self-held by the normally open contact $X_3$-$a_2$ which interlocks therewith.

Upon resetting of the water tray 116 to a predetermined position, the ninth switch $SW_9$ is turned on to open the water valve WV, and water is supplied to the freezing chamber 129 defined in the water tray 116 through the water supply pipe 149. Since the water tray 116 is designed to be stopped in the horizontal posture after it is turned once clockwise over the horizontal posture such that the wall 116*d* may be higher than the wall 116*e* and then counterclockwise, a predetermined amount of water is designed to be carried securely in the freezing chamber 129. If water to be frozen is supplied in an excess amount to the freezing chamber 129, it is adapted to flow over the dam plate 148, as described above and to be discharged to the outside of the machine through the auxiliary chamber 146 and the water collecting section 119.

The rotation of the actuator motor AM is stopped upon turning off of the seventh switch $SW_7$ as the motor AM is rotated, and the water tray 116 is stopped in the horizontal posture. Meanwhile, rotation of the rocking motor RM is started upon closure of the normally closed contact $X_2$-$b_2$ which interlocks with the relay $X_2$. Upon turning off of the seventh switch $SW_7$, the water valve WV is closed to stop supply of water. However, the ninth switch $SW_9$ is allowed to hold the ON-state.

(Freezing operation)

Figure 39:
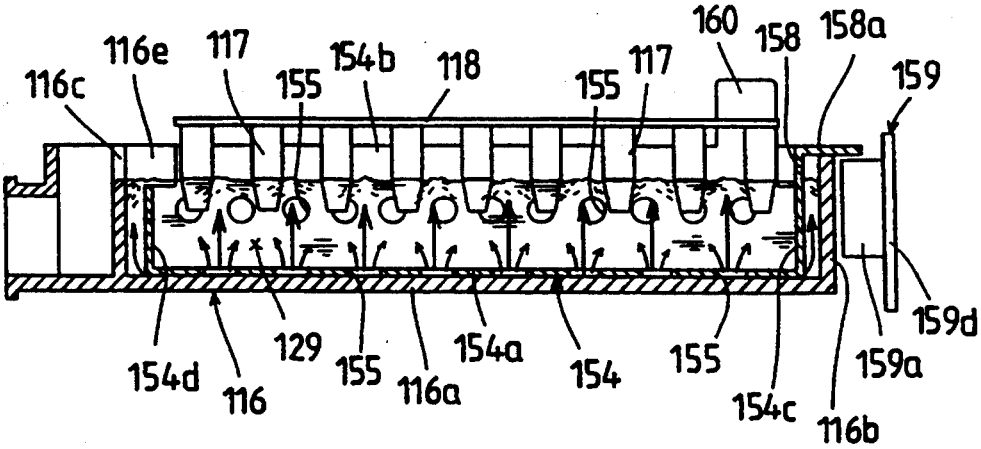
FIG. 39 shows in vertical sect ion the major port ion of the freezing unit, where the rocking protrusion is retracted from the engagement piece of the rocking plate to descend the rocking plate.

A cooling medium is supplied to the evaporator 131 through a circulation pipe of the freezing system by a compressor CM powered by electricity, and cooling of the freezing fingers 117 provided on the freezing base plate 118 is started by the heat exchange action of the cooling medium. Since the freezing fingers 117 are dipped in the water to be frozen, the water starts to freeze around the freezing fingers 117 and grows gradually into inverted dome-shaped ice pieces 121. During such freezing operation, the rocking motor RM is continuously rotated. Accordingly, the rocking protrusion 159*a* of the rocking member 159 rotated by the motor RM is engaged with the engagement piece 158 provided on the side wall 154*c* to lift the rocking plate 154, as shown in FIG. 29. Upon disengagement of the rocking protrusion 159*a* from the engagement piece 158, the rocking plate 154 drops by its own weight and is abutted against the bottom 116*a* of the freezing chamber 129. Thus, the rocking plate 154 repeats such rocking motion in the water to be frozen in the freezing chamber 129 during the freezing operation to constantly agitate the water (see FIGS. 37 to 39). In addition, since through holes 155 are formed on the rocking rocking plate 154, the water to be frozen flows through these through holes 155 as the rocking plate 154 is rocked to cause jet streams which accelerate the agitation of the water to be frozen. Moreover, these through holes 155 formed on the bottom plate 154*a* are designed to locate between every two adjacent freezing fingers 117, and thus the agitation of the water to be frozen can be accelerated around the freezing fingers 117. Since the water to be frozen is constantly maintained in a dynamic state, as described above, opacification to white of the ice pieces 121 to be formed around the freezing fingers 117 can be prevented, and transparent and clear ice pieces 121 can be obtained. Meanwhile, the side walls 154*c*, 154*d* of the rocking plate 154 also accelerate agitation of the water to be frozen staying near the corresponding walls 116*b*, 116*c* of the water tray 116, as shown in FIG. 39, to allow formation of transparent and clear ice pieces 121 around all of the freezing fingers 117 provided on the freezing base plate 118.

(Ice releasing operation)

As shown in FIG. 30, upon formation of inverted dome-like ice pieces 121 fully around the freezing fingers 117, the rocking plate 154 is brought into contact with the ice pieces 121 in its upward stroke and finally exerts a downward counterforce to the rocking motor RM through the engagement piece 158 and the rocking protrusion 159*a*. Accordingly, the fixture 138 having mounted thereon the rocking motor RM starts to make a counterclockwise turn on the bearing 134 to allow the cam 159*b* of the rocking member 159 to depress the lever 162 of the tenth switch $SW_{10}$ for detecting completion of ice formation to be changed over from the contact "a" to the contact "b", and thus completion of ice formation in the freezing unit 115 is detected. Whereupon the self-hold of the relay $X_3$ shown in FIG. 28 is released to close the normally closed contact $X_3$-b which interlocks therewith and start rotation of the actuator motor AM. Thus, the cam plate 136 is turned counterclockwise to tilt counterclockwise the lever 133*b* of the pivotal shaft 133 engaged with the connection rod 137 connected eccentrically thereto, and thus the water tray 116 starts to be tilted downward (see FIG. 32). By this tilting motion of the water tray 116, the water remaining in the freezing chamber 129 flows over the dam plate 148 into the auxiliary chamber 146 and then discharged to the water collecting section 119 therefrom. Incidentally, during the process that the water tray 116 is tilted, actuation of the ninth switch $SW_9$ by the second cam 151 of the cam late 136 rotated by the actuator motor AM is released (see FIG. 40).

The rocking motor RM continues to rotate even after the tenth switch $SW_{10}$ for detecting completion of ice formation is changed over to the contact "b" when the lever 162 thereof is depressed by the cam 159*b* of the rocking member 159. Thus, the rocking protrusion 159*a* provided on the rocking member 159 is spaced from the upper horizontal portion 158*a* to allow the fixture 138 to turn clockwise under the resilient action of the torsion spring 139, in turn, to change over the tenth switch $SW_{10}$ from the contact "b" to the contact "a" and stop temporarily the rocking motor RM. Accordingly, the upper end of the engagement piece 133*e* of the lever 133*b* is shifted to a position lower than the upper end of the vertical member 138*a* formed on the fixture 138 to allow the end 139*b* of the torsion spring 139 to be engaged with the upper end of the vertical member 138*a*, where the torsion spring 139 exerts no resilient action to the fixture 138 (see FIG. 36(*b*)). Whereupon, the fixture 138 starts to turn counterclockwise on the bearing 134 by its own weight to allow the cam 159*b* to change over the tenth switch $SW_{10}$ from the contact "a" to the contact "b" and start the rocking motor RM. The depression of the lever 162 is released when the notch 159*c* formed on the cam 159*a* comes to the position corresponding to the location of the lever 162 to change over the switch $SW_{10}$ from the contact "b" to the contact "a" and stop rotation of the rocking motor RM (see FIG. 36 (*c*)). Thus, the rocking protrusion 159*a* provided on the rocking member 159 stops at a position deviated from the tilting orbit of the engagement piece 158 of the rocking plate 154, where it does not interfere with the tilting motion of the rocking plate 154.

If a power failure should occur during the freezing operation, the fixture 138 is turned counterclockwise by the tilting of the water tray after power recovery to change over the tenth switch $SW_{10}$ to the contact "b" and rotate the rocking motor RM, so that the rocking member 159 is turned to the position where the notch 159*c* can be engaged with the lever 162. Namely, the rocking protrusion 159*a* can securely be brought to a position spaced from the tilting orbit of the engagement piece 158, whenever a power failure occurs.

Figure 33:
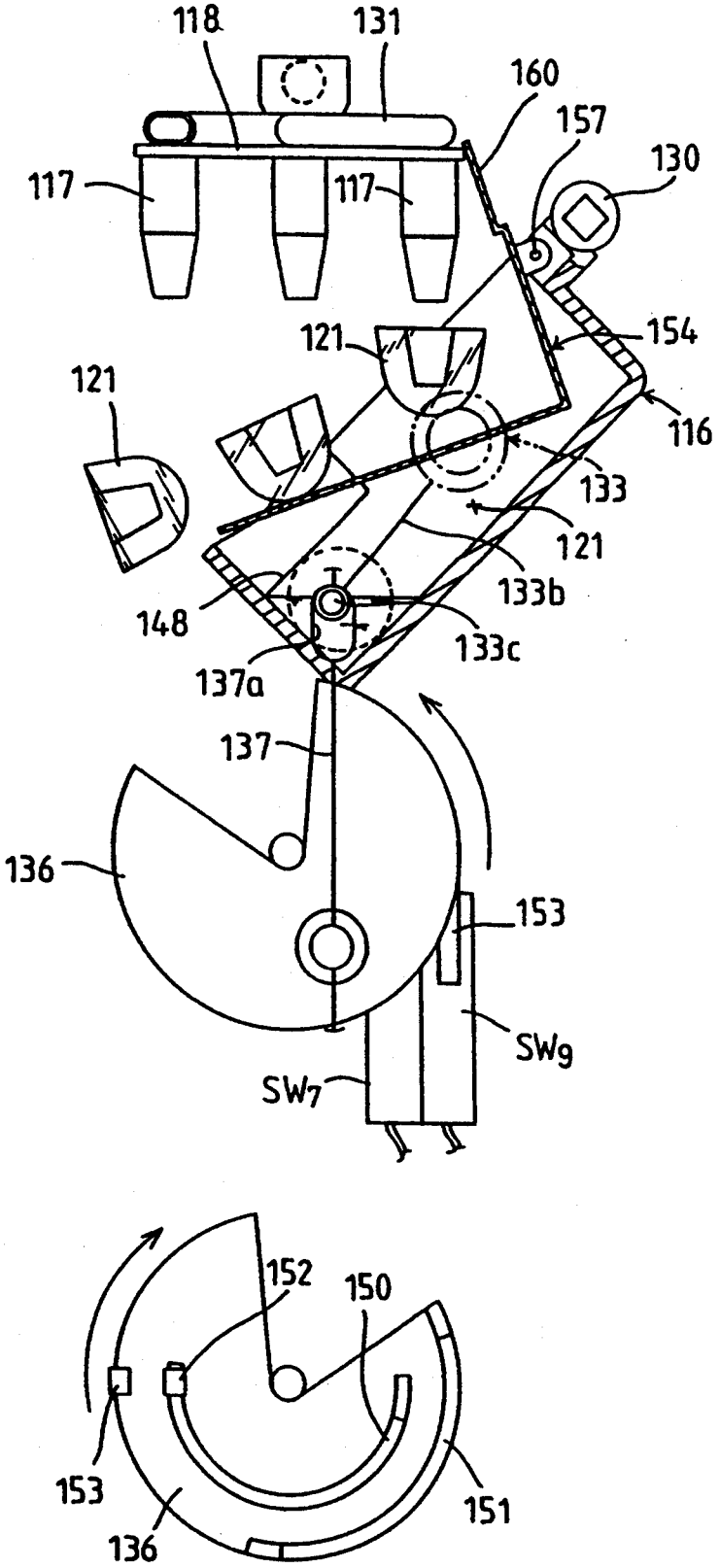
FIG. 33 shows an explanatory view of the freezing unit where the water tray in the ice making machine is stopped in the tilted posture, together with the positional relationship between the cam plate of the tilting mechanism assuming a corresponding posture and a seventh switch and a ninth switch.

Upon arrival of the first cam 150 provided on the cam plate 136 to the lever 152 of the seventh switch $SW_7$, the switch $SW_7$ is turned on to actuate the relay $X_2$ and to open the normally closed contact $X_2$-$b_1$ which interlocks therewith, as well as, to close the normally open contact $X_2$-a. In this state, the thermometal switch Th1 for detecting completion of the ice releasing operation is connected to the contact "b", since ice pieces 121 are formed fully around the freezing fingers 117. Accordingly, the relay $X_3$ is not actuated, and the rotation of the actuator motor AM is stopped to to allow the water tray 116 to stop in a tilted posture at a predetermined angle, as shown in FIG. 33. In this state, while a portion of the water to be frozen remains in the freezing chamber 129 due to the presence of the dam plate 148, such residual water, fully cooled during the previous freezing operation, is mixed with another portion of water to be supplied afresh to cool effectively the thus combined water to be frozen. Meanwhile, the ice pieces 121 formed around the freezing fingers 117 are exposed as such by tilting the water tray 116. Further, in the process that the water tray 116 is tilted and stopped in the tilted posture, the vertical member 160 of the rocking plate 154 is abutted against the freezing base plate 118, so that the rocking plate 154 is allowed to locate diagonally above the bottom 116*a* of the freezing chamber 129 in the water tray 116 which stops later in the tilted posture. The rocking plate 154 also functions as a chute for guiding the ice pieces 121 dropping from the freezing fingers 117 into the ice chamber 183. In addition, the notches 180 formed along the free end portion of the rocking plate 154 can prevent effectively the water remaining in the water tray 116 from flowing over the wall 116*d* thereof, when the water tray 116 is tilted.

Figure 40:
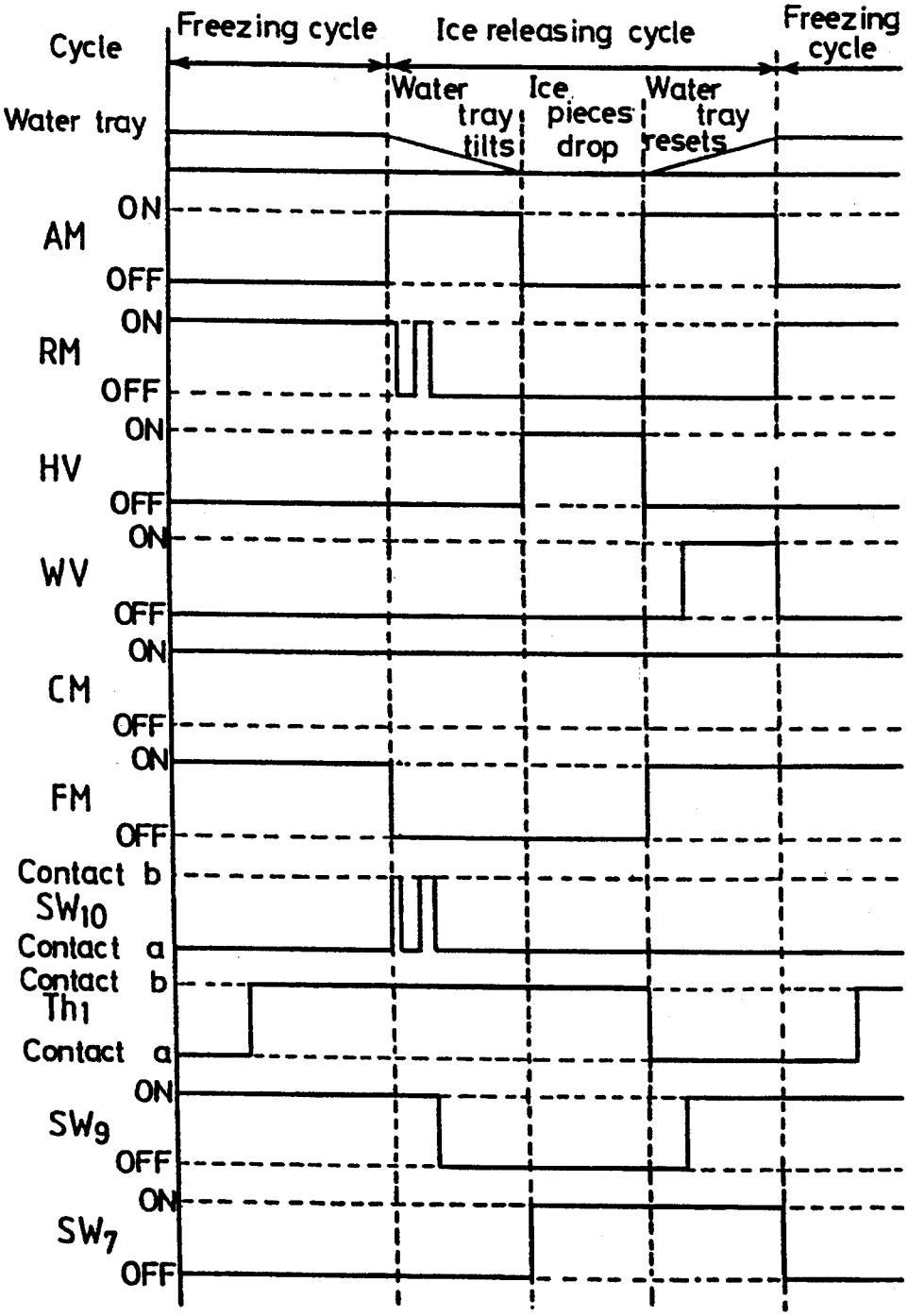
FIG. 40 shows a control timing chart in the ice making machine.

Simultaneously with the stopping of the actuator motor AM, the hot gas valve HV is opened to supply a hot gas, instead of the cooling medium, to the evaporator 131, as shown in the timing chart of FIG. 40, so that the freezing fingers 111 are rapidly heated through the freezing base plate 118. Accordingly, the bondage between the freezing fingers 117 and the ice pieces 121 is released, and the ice pieces 121 drop by their own weights, slide on the upper surface of the rocking plate 154 maintained in a predetermined tilted posture by the vertical member 160 and are guided into the ice chamber 183.

The negative temperature load applied to the freezing base plate 118 is released by the dropping of the ice pieces 121, and the temperature of the freezing base plate 118 is suddenly elevated by the passage the hot gas through the evaporator 131. This temperature rise is detected by the thermometal switch $Th_1$, which is immediately changed over to the contact "a" to actuate the relay $X_3$, in turn, to close the normally open contact $X_3$-$a_1$ which interlocks therewith and allows the actuator motor AM to resume rotation. Meanwhile, the hot gas valve HV is also closed to resume supplying of the cooling medium to the evaporator 131.

Figure 34:
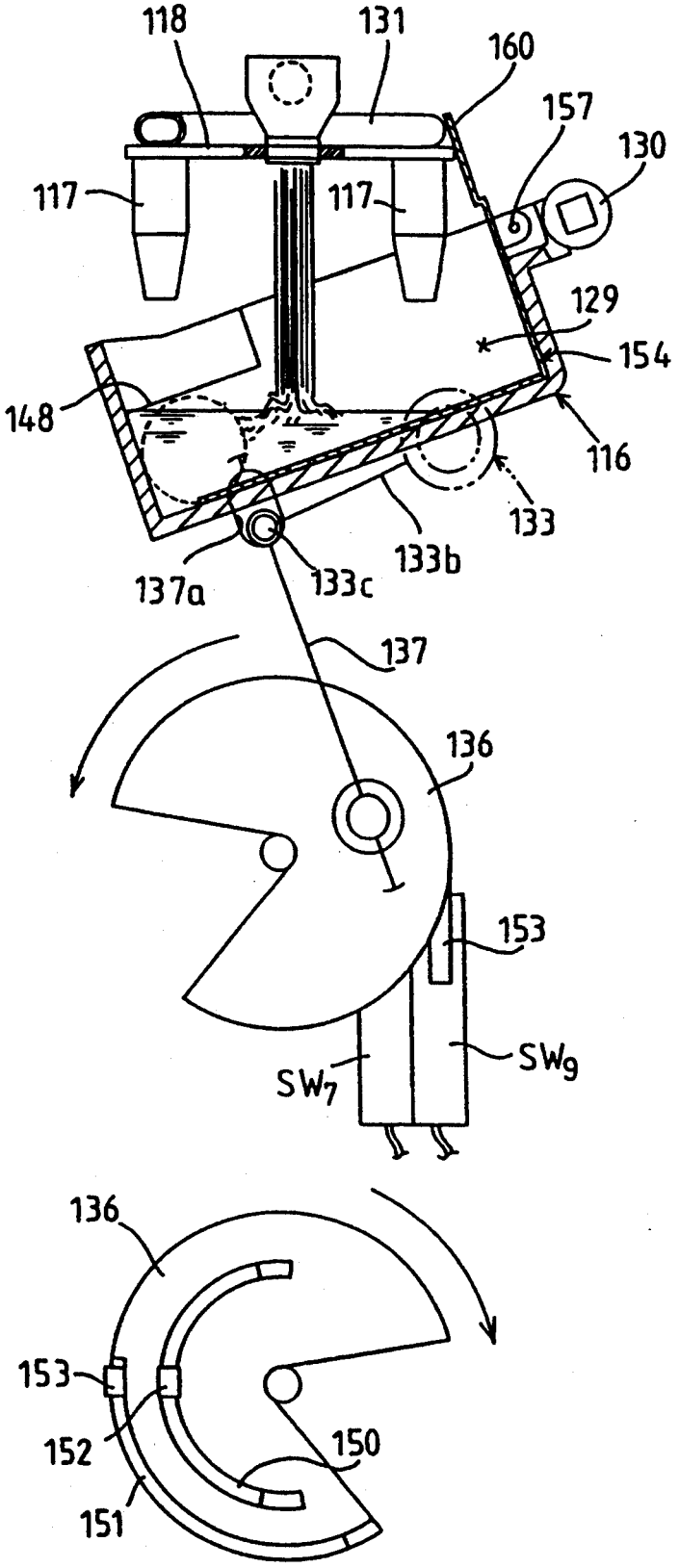
FIG. 34 shows an explanatory view of the freezing unit where the water tray in the ice making machine is resetting, together with the positional relationship between the cam plate of the tilting mechanism assuming a corresponding posture and the seventh and ninth switches.
Figure 35:
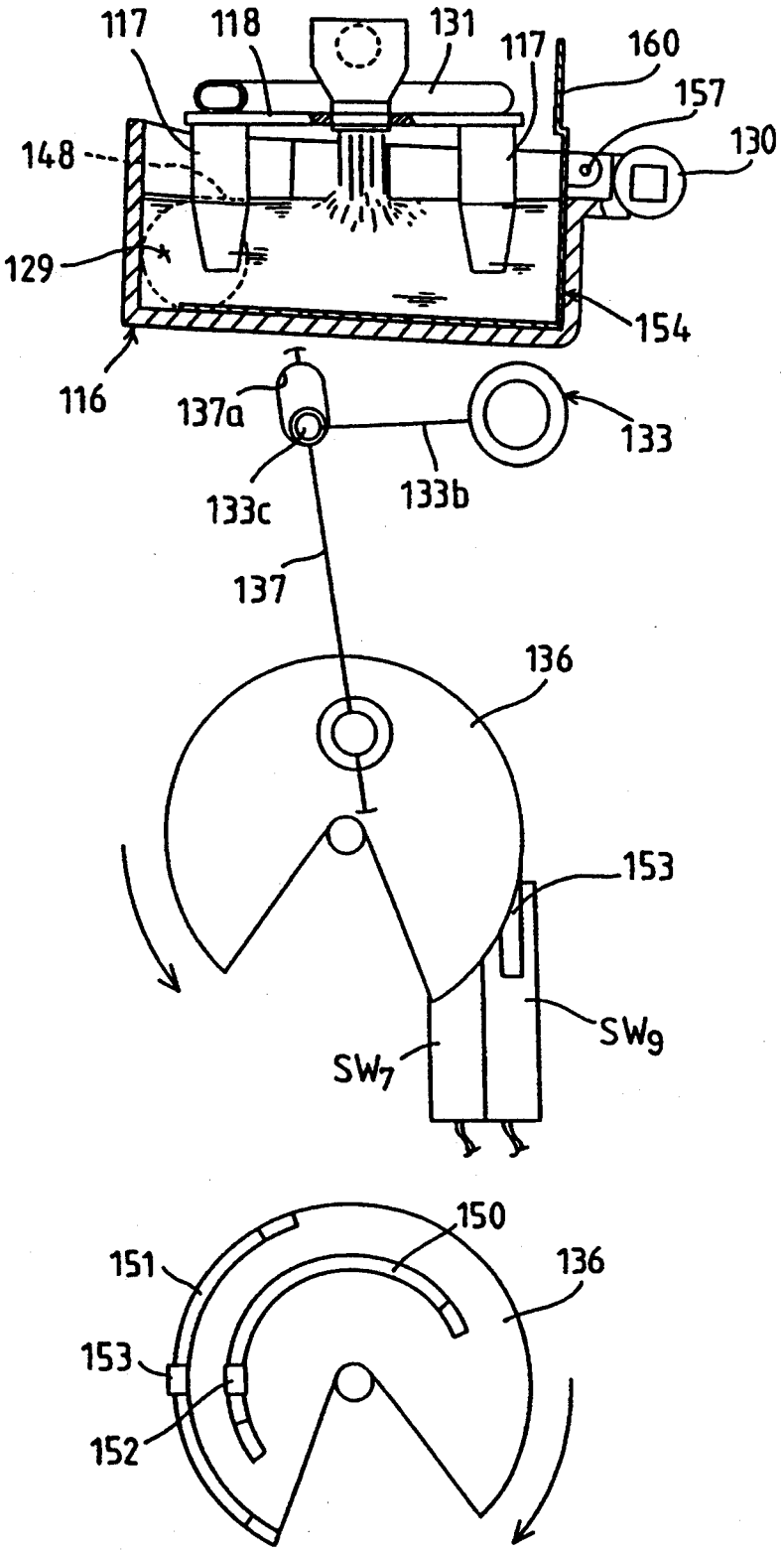
FIG. 35 shows an explanatory view of the freezing unit where the water tray in the ice making machine is counter-tilted over the horizontal posture, together with the positional relationship between the cam plate of the tilting mechanism assuming a corresponding posture and the seventh and ninth switches.

The pivotal shaft 133 is turned clockwise under the actions of the cam plate 136, connection rod 137 and lever 133*b* by this rotation of the motor AM, and the water tray 116 is likewise turned clockwise to start resetting to the horizontal posture. Meanwhile, the second cam 151 of the cam plate 136 comes to the lever 153 of the ninth switch $SW_9$ as the motor AM resumes rotation to turn on the switch $SW_9$, as shown in FIG. 34, whereby the water valve WV is opened to supply water to be frozen to the freezing chamber 129 again.

Upon disengagement of the first cam 150 of the cam plate 136 from the lever 152 of the seventh switch $SW_7$, actuation of the switch $SW_7$ is released to close the water valve WV and stop supplying of water to be frozen as well as to stop the actuator motor AM. This is because the relay $X_3$ is self-held to open the normally closed contact $X_3$-b thereof. Thus, the water tray 116 is stopped in the horizontal posture.

Incidentally, in the second embodiment, resetting of the water tray 116 to the horizontal posture is designed to be carried out by turning once the water tray 116 clockwise over the horizontal posture such that the free end portion thereof (the wall 116*d* side) may be higher than the fixed end portion thereof and then turning counterclockwise to stop in the horizontal posture. Namely, if water to be frozen is supplied in a sufficient amount to the freezing chamber 129 with the dam plate 148 provided in the water tray 116 locating at a high level to let the water to flow over the dam plate 148, a necessary amount of water to be frozen is adapted to be securely supplied to the freezing chamber 129 when the water tray 116 is reset to the horizontal posture. Thus, possible troubles to be caused by the lack of water to be frozen can be prevented.

Figure 36:
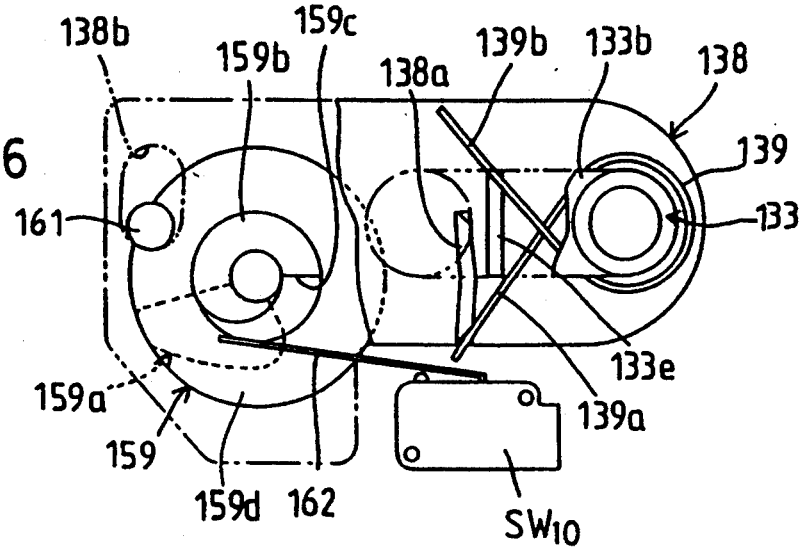
FIG. 36*a–c* show explanatory views of the motions of the rocking mechanism for the rocking plate in the ice making machine, where the rocking protrusion of the rocking member is retracting from the tilting orbit of the engagement piece of the rocking plate after detection of completion of ice formation.
Figure 36:
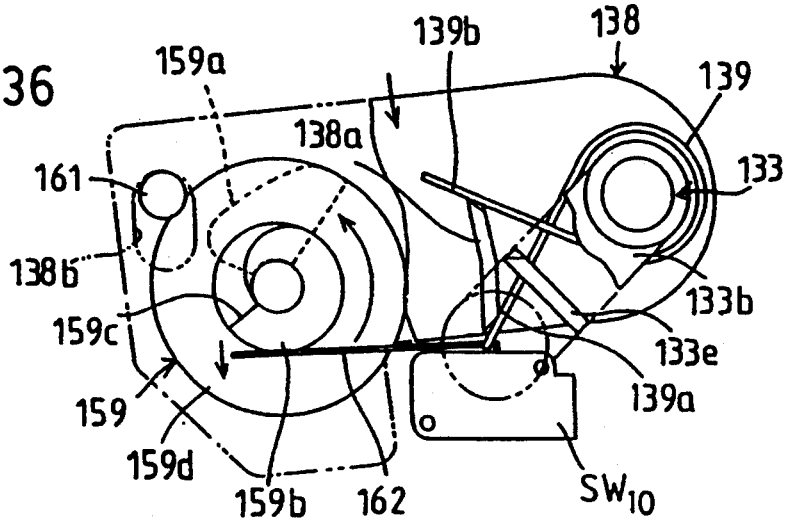
Figure 36:
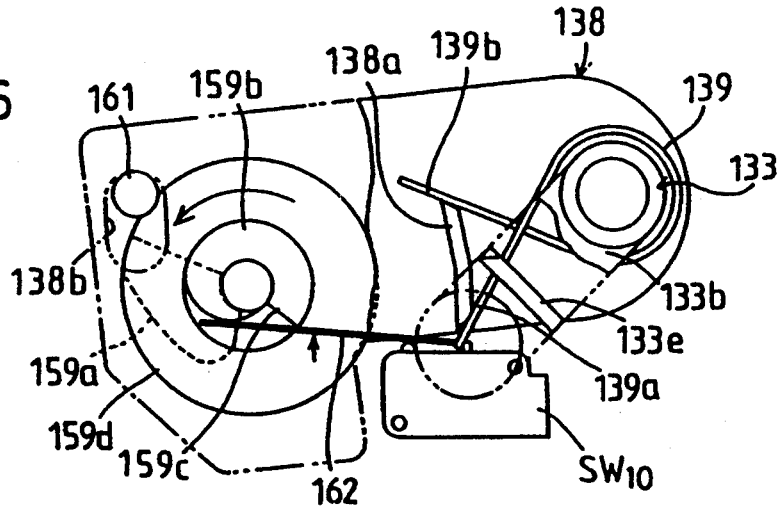

Meanwhile, as the pivotal shaft 133 is turned clockwise, the upper end of the engagement piece 133*e* of the lever 133*b* shifts upward to a position higher than the upper end of the vertical member 138*a* of the fixture 138, so that the end portion 139*b* of the torsion spring 139 is engaged with the upper end of the engagement piece 133*e* (see FIG. 36(*a*)). Thus, the fixture 138 is turned clockwise on the pivotal shaft 133 by the resilience of the torsion spring 139, to allow the rocking protrusion 159*a* of the rocking member 159 to be in the operational position where it can be engaged with the engagement piece 158 of the rocking plate 154. Accordingly, upon releasing actuation of the relay $X_2$ by the turning off of the seventh switch $SW_7$, the normally closed contact $X_2$-$b_2$ which interlocks therewith is closed to rotate the rocking motor RM and allow the rocking plate 154 to resume and continue the rocking motion during the freezing operation.

When the water tray 116 is tilted after completion of the freezing operation with a predetermined amount of ice pieces 121 being stored in the ice chamber 183 by repeating the freezing operation and the ice releasing operation, the detection plate 166 is abutted against the group of ice pieces in the tilting process thereof, and it is prevented thereby from tilting further. Thus, the detection plate 166 is turned clockwise relative to the water tray 116 to turn on the eighth switch $SW_8$ for detecting ice fullness. In this state, the seventh switch $SW_7$ shown in FIG. 28 is turned on to actuate the relay $X_1$, whereby the normally closed contacts $X_1$-$b_1$ and $X_1$-$b_2$ are opened to stop rotation of the actuator motor as well as to stop energization of the compressor CM.

Meanwhile, while dew drops are formed on the freezing base plate 118 by repeating the freezing operation and the ice releasing operation, they do not stay on the upper surface of the freezing base plate 118 but drop through the through holes 118*a*, whereby reduction in the cooling efficiency due to the freezing of the dew drops and growth thereof to form unnecessary ice can be prevented. Further, since such unnecessary ice does not grow outward from the side edges of the freezing base plate 118 to prevent interfere with the water tray 116 and the rocking plate 154, and thus interference of the tilting motion of the water tray 116 and the rocking motion of the rocking plate 154 does not occur.

Incidentally, in the illustrated embodiments of the invention, while the freezing fingers 36, 117 extending at predetermined intervals from the lower surface of the freezing base plate 34, 118 are tapered downward, the shape of the freezing fingers 36, 117 may not limited thereto, and various modifications such as round bars, pins, etc. can suitably be employed, so long as they function as, as it were, nuclear freezing members.

What is claimed is:

1. A mechanism for detecting completion of ice formation in an ice making machine having an evaporator connected to a freezing system including a compressor and a condenser; a freezing base plate having a multiplicity of freezing fingers formed on the lower surface thereof at predetermined intervals, with said evaporator being disposed on the upper surface thereof; and a water tray pivotally supported on the main body side of the ice making machine to maintain normally a horizontal posture and having defined therein a freezing chamber, for carrying water to be frozen in which said freezing fingers are to be dipped; said water tray being adapted to be tilted downward upon freezing of the water to form ice pieces around the freezing fingers; characterized in that said mechanism consists of:

a rocking plate disposed in said freezing chamber, which can be rocked to be able to be in contact with the bottom of said freezing chamber;

a fixture pivotally supported on the main body side of the ice making machine, on which a rocking motor is to be mounted;

a rocking means disposed to be pivotable integrally with said fixture and to be rotated by said rocking motor;

an engagement member provided on said rocking means for rocking said rocking plate by the rotation of said rocking motor under the action of another engagement member provided on said rocking plate engaged therewith;

a detect ion means for detecting completion of ice formation locating on the turning orbit of said rocking means; and a resilient member engaged with said fixture, for resiliently urging said rocking means away from said detection means;

wherein completion of ice formation around said freezing fingers is designed to be detected upon actuation of said detection means by the rocking means as said fixture is turned against the resilience of said resilient member, when said rocking plate is brought into contact with the ice pieces formed around said freezing fingers to apply a counterforce to said fixture through said rocking means, in the rocking motion of said rocking plate through said engagement member of said rocking means rotated by said rocking motor in engagement with said engagement member of said rocking plate.

2. The mechanism for detecting completion of ice formation in an ice making machine according to claim 1, wherein said resilient member is a torsion spring disposed to the main body side of the ice making machine, which is designed to release its urging force applied to said fixture when said water tray is tilted downward upon detection of completion of ice formation.

3. A mechanism for detecting completion of ice formation in an ice making machine having an evaporator connected to a freezing system including a compressor and condenser; and a freezing base plate having freezing fingers formed on one surface thereof, with said evaporator being disposed on the other surface thereof; characterized in that said mechanism consists of:

a rocking plate which is rocked with respect to said freezing fingers by a rocking means; and a position detector which is actuated when a predetermined size of ice pieces are formed around the freezing fingers, and said rocking plate is brought into contact with these pieces; and wherein completion of ice formation around said freezing fingers is designed to be detected by a signal from said position detector and said rocking plate is rocked during freezing operation so as to agitate water to be frozen inside a freezing chamber, thus preventing opacification to white from being formed in ice pieces and has through holes formed at predetermined intervals for allowing passage of water to be frozen therethrough during rocking of said rocking plate.

4. The mechanism for deceting completion of ice formation in an ice making machine according to claim 1, wherein said rocking means consists of a rocking motor provided on the main body side of the ice making machine, an engagement piece protruding radially from the rotary shaft of said rocking motor and an engagement pin protruding horizontally from the free end portion of said rocking plate, whereby said rocking plate is allowed to perform a rocking motion on a rocking shaft by said engagement piece rotated by said rocking motor, which repeats engagement and disengagement with respect to said engagement pin.

5. The mechanism for detecting completion of ice formation in an ice making machine according to claim 1, wherein said rocking plate has formed along one side edge of the bottom plate thereof a side wall at which said rocking plate is supported to be able to be rocked with respect to said water tray, and a plurality of through holes are defined on said bottom plate and side wall, those through holes defined on said bottom plate are each positioned to locate between every two adjacent freezing fingers dipped in the water to be frozen.

6. The mechanism for detecting completion of ice formation in an ice making machine according to claim 5, wherein said bottom plate of the rocking plate further has formed along the side edges thereof, orthogonal to said side wall a pair of side walls with a predetermined height.

7. The mechanism for detecting completion of ice formation in an ice making machine according to one of claims 5 or 6, wherein said rocking plate has formed along the free end of the bottom thereof a plurality of notches at predetermined intervals.

8. The mechanism for detecting completion of ice formation in an ice making machine according to claim 5, wherein said rocking means consists of a rocking motor provided on the main body side of the ice making machine, a rocking member disposed to the rotary shaft of said rocking motor, a rocking protrusion protruding eccentrically from one surface of said rocking member and a horizontal portion extending horizontally from the free end portion of said rocking plate, whereby said rocking plate is allowed to perform a rocking motion by said rocking protrusion rotated by said rocking motor, which repeats engagement and disengagement with respect to said horizontal portion.

* * * * *